US005473889A

United States Patent [19]

Ehard et al.

[11] Patent Number: 5,473,889

[45] Date of Patent: Dec. 12, 1995

[54] AIR-FUEL RATIO CONTROL SYSTEM FOR INTERNAL COMBUSTION ENGINES

[75] Inventors: Yasunori Ehar; Ken Ogawa; Joji Hijikata, all of Wako, Japan

[73] Assignee: Honda Giken Kogyo K.K. (Honda Motor Co., Ltd. in English), Tokyo, Japan

[21] Appl. No.: 310,887

[22] Filed: Sep. 22, 1994

[30] Foreign Application Priority Data

Sep. 24, 1993 [JP] Japan ..... 5-261606
Sep. 29, 1993 [JP] Japan ..... 5-265804

[51] Int. Cl.[6] ..... F01N 3/20
[52] U.S. Cl. ..... 60/276; 60/285
[58] Field of Search ..... 60/274, 276, 285

[56] References Cited

U.S. PATENT DOCUMENTS 5,077,970 1/1992 Hamburg ..... 60/276
5,090,199 2/1992 Ikuta ..... 60/276

*Primary Examiner*—Douglas Hart
*Attorney, Agent, or Firm*—Arthur L. Lessler

[57] ABSTRACT

An air-fuel ratio control system for an internal combustion engine detects a central value of an output from a first exhaust gas component concentration sensor arranged in an exhaust passage at a location upstream of a catalytic converter and having an output characteristic which is substantially proportional to the concentration of a component in the exhaust gases. The central value is corrected based on the output from the first exhaust gas component concentration sensor, when an output from a second exhaust gas concentration sensor arranged downstream of the catalytic converter falls within a predetermined range. The output from the first exhaust gas component concentration sensor is corrected based on the corrected central value. An air-fuel ratio of a mixture supplied to the engine is corrected based on the corrected output value from the first exhaust gas component concentration sensor.

12 Claims, 15 Drawing Sheets

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system which is adapted to control the air-fuel ratio of a mixture supplied to the engine to a desired air-fuel ratio, based on outputs from exhaust gas component concentration sensors arranged in an exhaust passage of the engine.

2. Prior Art

It is conventionally known to arrange an exhaust gas component concentration sensor (hereinafter referred to as "the LAF sensor") having an output characteristic which is substantially proportional to the concentration of an exhaust gas component, in an exhaust passage of an engine, and to feedback-control the air-fuel ratio of an air-fuel mixture supplied to the engine in response to the output from the LAF sensor to a desired air-fuel ratio.

The LAF sensor used in the air-fuel ratio control system is comprised of an oxygen-pumping element and a cell element each formed by a couple of electrodes mounted on opposite surfaces of a plate of oxygen ion-conductive solid electrolyte material. The two plates are arranged parallel whereby inner electrode-formed surfaces thereof partly define a gas diffusion chamber into which sample gases for detection are introduced via a slit, while the outer electrode-formed surface of the cell element faces an air chamber into which air is introduced.

In such a LAF sensor, the voltage generated by the cell element is compared with a predetermined reference voltage so as to apply voltage proportional to the difference between them to one of the electrodes of the oxygen-pumping element to cause a pumping current to flow through the oxygen-pumping element, thereby changing the oxygen concentration within the gas diffusion chamber toward a predetermined value (e.g. 0). A signal indicative of the pumping current has a level proportional to the concentration of oxygen, and is delivered from the LAF sensor via an amplifier circuit. A device for detecting the pumping current is formed by a current-detecting resistance connected in series with the oxygen-pumping element. The voltage detected across the opposite ends of the current-detecting resistance is taken out as a voltage representative of a value of the pumping current.

The LAF sensor has an oxygen concentration-detecting characteristic that the pumping current IP changes linearly with the oxygen concentration, on respective leaner and richer sides of the stoichiometric air-fuel ratio. The air-fuel ratio is detected by the LAF sensor by utilizing this relationship between the pumping current and the concentration of oxygen in exhaust gases. Actually, as describe above, the air-fuel ratio is determined from the voltage output from a pumping current-detecting block including the current-detecting resistance.

That is, the pumping current-detecting block outputs an output voltage VAF having a characteristic that it is substantially linear to the oxygen concentration in exhaust gases, and a central voltage VAFCENT, which assumes a value corresponding to a desired air-fuel ratio. The air-fuel ratio of a mixture supplied to the engine can be calculated from a difference detected between the output voltage VAF and the central voltage VAFCENT, and the air-fuel ratio feedback control is performed based on results of this calculation.

However, according to this technique of the air-fuel ratio feedback control, when the desired air-fuel ratio is set to a stoichiometric air-fuel ratio (A/F=14.7), it is often actually difficult to converge the air-fuel ratio of the mixture to the stoichiometric air-fuel ratio due to an error or tolerance in the output from the sensor caused by variations in characteristics or aging of an amplifier circuit connected to the LAF sensor or a ground potential difference, which results in degraded exhaust emission characteristics. Therefore, it is required to set a desired air-fuel ratio coefficient corresponding to the stoichiometric air-fuel ratio, used in the air-fuel ratio feedback control, to a value slightly deviated from 1.0, engine by engine, on shipment thereof.

To eliminate such an inconvenience, an air-fuel ratio control system has been proposed e.g. by Japanese Provisional Patent Publication (Kokai) No. 2-67443, which comprises a LAF sensor arranged in an exhaust passage of an engine at a location upstream of a catalytic converter, and an O2 sensor arranged in same at a location downstream of the catalytic converter, an output from which drastically changes when the air-fuel ratio of a mixture supplied to the engine changes across the stoichiometric air-fuel ratio.

This proposed system is based on the finding that an error in the output from the LAF sensor caused by variations in output characteristics between individual amplifier circuits and/or between sensors per se or aging of the amplifier circuit and the sensor per se results in a change in the inclination of an output line indicative of the detected current (the pumping current IP) depicted relative to the air-fuel ratio as it changes from a stoichiometric air-fuel ratio to the air-fuel ratio of the air. Based on this finding, the proposed system attempts to accurately control the air-fuel ratio to the stoichiometric airfuel ratio and also accurately control the air-fuel ratio over an entire control range thereof by learning a change in the inclination indicative of the output characteristic of the LAF sensor located upstream of the catalytic converter, based on the output from the O2 sensor arranged downstream of the catalytic converter, and correcting the inclination.

However, even the proposed method of learning an inclination of the output characteristic of the LAF sensor for correction is susceptible to effects due to variations in output characteristics between individual sensors per se and/or between amplifier circuits connected thereto, aging thereof, a ground potential difference, etc., as is the case with the first-mentioned conventional system employing the LAF sensor alone, and hence cannot accurately detect the central voltage VAFCENT of the LAF sensor. As a result, it is impossible to determine a control amount of the air-fuel ratio of the mixture with high accuracy, which makes it difficult to perform the air-fuel ratio control with high accuracy and hence constantly obtain the maximum purifying efficiency of the catalytic converter, resulting in degraded exhaust emission characteristics.

SUMMARY OF THE INVENTION

It is a first object of the invention to provide an air-fuel ratio control system for an internal combustion engine, which is capable of performing high-accuracy air-fuel ratio control so as to obtain the maximum purifying efficiency of a catalytic converter arranged in the exhaust system of the engine, thereby achieving improved exhaust emission characteristics of the engine.

It is a second object of the invention to provide an air-fuel ratio control system for an internal combustion engine, which is capable of accurately determining a central voltage output from a LAF sensor arranged in the exhaust system of the engine, thereby performing the air-fuel ratio control with high accuracy, and hence achieving improved exhaust emission characteristics of the engine.

To attain the objects, according to a first aspect of the invention, there is provided an air-fuel ratio control system for an internal combustion engine having an exhaust passage, and a catalytic converter arranged in the exhaust passage for purifying noxious components contained in exhaust gases from the engine, the air-fuel ratio control system including a first exhaust gas component concentration sensor arranged in the exhaust passage at a location upstream of the catalytic converter and having an output characteristic which is substantially proportional to concentration of a specific component in the exhaust gases, and a second exhaust gas component concentration sensor arranged in the exhaust passage at a location downstream of the catalytic converter and having an output characteristic that an output therefrom drastically changes as an air-fuel ratio of a mixture supplied to the engine changes across a stoichiometric air-fuel ratio.

The air-fuel ratio control system according to the first aspect of the invention is characterized by comprising:

central value-detecting means for detecting a central value of an output from the first exhaust gas component concentration sensor, the central value serving as a reference value based on which the first exhaust gas Component concentration sensor delivers the output;

central value-correcting means for correcting the central value based on the output from the first exhaust gas component concentration sensor to obtain a corrected central value, when the output from the second exhaust gas component concentration sensor falls within a predetermined range;

output value-correcting means for correcting a value of the output from the first exhaust gas component concentration sensor, based on the corrected central value to obtain a corrected output value; and actual air-fuel ratio-calculating means for calculating an actual value of the air-fuel ratio of the mixture supplied to the engine, based on the corrected output value from the first exhaust gas component concentration sensor.

Preferably, the central value is corrected such that the central value accurately corresponds to a stoichiometric air-fuel ratio.

Preferably, the predetermined range of the output from the second exhaust gas component concentration sensor is set to a range in which the catalytic converter exhibits the maximum purifying efficiency.

Preferably, the air-fuel ratio control system includes engine operating condition-detecting means for detecting operating conditions of the engine, desired air-fuel ratio-determining means for determining a desired air-fuel ratio of the mixture supplied to the engine, based on results of detection by the engine operating condition-detecting means, desired air-fuel ratio-correcting means for correcting the desired air-fuel ratio determined by the desired air-fuel ratio-determining means, based on the output from the second exhaust gas component concentration sensor, and control means for controlling the air-fuel ratio of the mixture supplied to the engine, according to the corrected desired air-fuel ratio and the actual value of the air-fuel ratio calculated by the actual air-fuel ratio-calculating means.

To attain the above objects, according to a second aspect of the invention, there is provided an air-fuel ratio control system for an internal combustion engine having an exhaust passage, and a catalytic converter arranged in the exhaust passage for purifying noxious components contained in exhaust gases from the engine, the air-fuel ratio control system including an exhaust gas component concentration sensor arranged in the exhaust passage at a location upstream of the catalytic converter for delivering an output based on a pumping current flowing therein and being substantially proportional to concentration of a specific component in the exhaust gases.

The air-fuel ratio control system according to the second aspect of the invention is characterized by comprising:

sensor activation-determining means for detecting an activated state of the exhaust gas component concentration sensor;

pumping current absence-detecting means for detecting a predetermined pumping current state of the exhaust gas component concentration sensor in which no pumping current flows therein;

central value-calculating means for calculating a central value of the output from the exhaust gas component concentration sensor to obtain a calculated central value, based on the output from the exhaust gas concentration sensor, when the activated state of the first exhaust gas component concentration sensor is detected and at the same time the predetermined pumping current state of the exhaust gas component concentration sensor is detected, the central value serving as a reference value based on which the exhaust gas component concentration sensor delivers the output;

output value-correcting means for correcting a value of the output from the exhaust gas component concentration sensor based on the calculated central value to obtain a corrected output value; and actual air-fuel ratio-calculating means for calculating an actual value of an air-fuel ratio of a mixture supplied to the engine, based on the corrected output value from the exhaust gas component concentration sensor.

Preferably, the central value-calculating means learns an average value of the central value.

More preferably, the air-fuel ratio control system includes operating condition-detecting means for detecting operating conditions of the engine, desired air-fuel ratio-calculating means for calculating a desired air-fuel ratio of the mixture supplied to the engine, based on results of detection by the operating condition-detecting means, a second exhaust gas component concentration sensor arranged in the exhaust passage at a location downstream of the catalytic converter and having an output characteristic that an output therefrom drastically changes as the air-fuel ratio of the mixture supplied to the engine changes across a stoichiometric air-fuel ratio, correction value-learning means for learning a correction value for the desired air-fuel ratio, desired air-fuel ratio-correcting means for correcting the desired air-fuel ratio, based on the learned correction value, and control means for controlling the air-fuel ratio of the mixture supplied to the engine, based on the corrected desired air-fuel ratio and the actual value of the air-fuel ratio.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
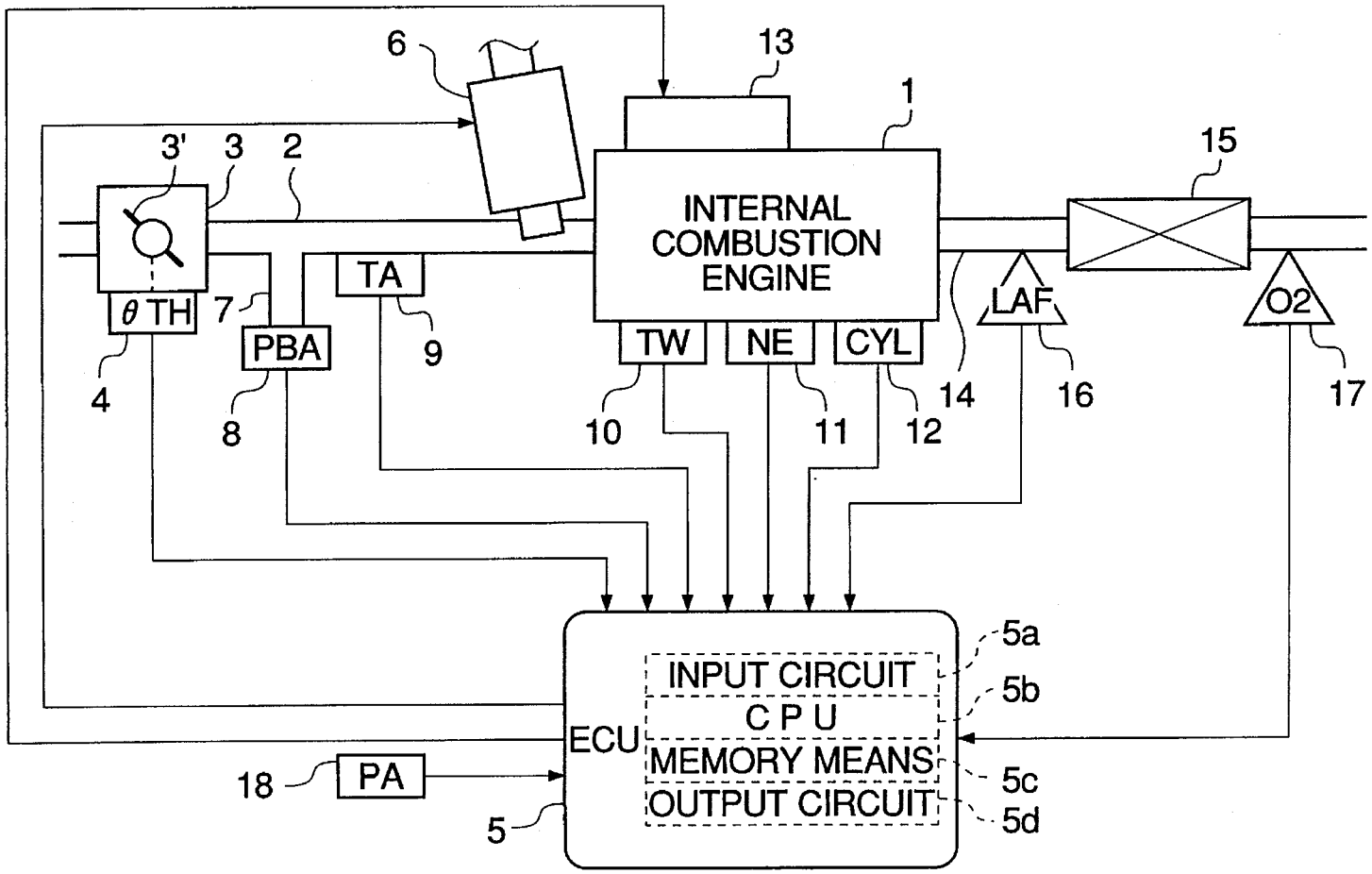
FIG. 1 is a block diagram showing the whole arrangement of an air-fuel ratio control system for an internal combustion engine according to the invention.

Referring first to FIG. 1, there is illustrated the whole arrangement of an air-fuel ratio control system for an internal combustion engine according to the invention.

In the figure, reference numeral 1 designates an internal combustion engine (hereinafter simply referred to as "the engine") having four cylinders, not shown, for instance. Connected to the cylinder block of the engine 1 is an intake pipe 2 across which is arranged a throttle body 3 accommodating a throttle valve 3' therein. A throttle valve opening (θTH) sensor 4 is connected to the throttle valve 3' for generating an electric signal indicative of the sensed throttle valve opening and supplying same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

Further, an intake pipe absolute pressure (PBA) sensor 8 is provided in communication with the interior of the intake pipe 2 via a conduit 7 opening into the intake pipe 2 at a location downstream of the throttle valve 3' for supplying an electric signal indicative of the sensed absolute pressure within the intake pipe 2 to the ECU 5.

An intake air temperature (TA) sensor 9 is inserted into the intake pipe 2 at a location downstream of the conduit 7 for supplying an electric signal indicative of the sensed intake air temperature TA to the ECU 5.

An engine coolant temperature (TW) sensor 10 formed of a thermistor or the like is inserted into a coolant passage filled with a coolant and formed in the cylinder block, for supplying an electric signal indicative of the sensed engine coolant temperature TW to the ECU 5.

An engine rotational speed (NE) sensor 11 and a cylinder-discriminating (CYL) sensor 12 are arranged in facing relation to a camshaft or a crankshaft of the engine 1, neither of which is shown.

The NE sensor 11 generates a pulse as a TDC signal pulse at each of predetermined crank angles whenever the crankshaft rotates through 180 degrees, while the CYL sensor 12 generates a pulse at a predetermined crank angle of a particular cylinder of the engine, both of the pulses being supplied to the ECU 5.

Each cylinder of the engine has a spark plug 13 electrically connected to the ECU 5 to have its ignition timing controlled by a signal therefrom.

A catalytic converter (three-way catalyst) 15 is arranged in an exhaust pipe 14 connected to the cylinder block of the engine 1, for purifying noxious components in the exhaust gases, such as HC, CO, and NOx.

A linear oxygen concentration sensor (hereinafter referred to as "the LAF sensor") 16 and an oxygen concentration sensor (hereinafter referred to as "the O2 sensor") 17 are arranged in the exhaust pipe 14 at locations upstream and downstream of the three-way catalyst 15, respectively.

As will be described in further detail hereinbelow, the LAF sensor 16 is comprised of a sensor element formed of a solid electrolytic material of zirconia (ZrO2) and having a pair of a cell element and an oxygen-pumping element mounted on respective locations thereof, and an amplifier circuit electrically connected to the sensor element. The LAF sensor 16 delivers to the ECU 5 an electric signal indicative of an output voltage VAF which is substantially proportional to the oxygen concentration in exhaust gases flowing through the sensor element, and an electric signal indicative of a central voltage VAFCENT corresponding to a stoichiometric air-fuel ratio.

The O2 sensor 17 is also formed of a solid electrolytic material of zirconia ($ZrO_2$) like the LAF sensor 16 and having a characteristic that an electromotive force thereof drastically changes when the air-fuel ratio of the mixture changes across the stoichiometric value, so that an output signal therefrom is inverted from a lean side to a rich side, or vice versa, when the air-fuel ratio of the mixture changes across the stoichiometric value. More specifically, the O2 sensor 17 generates and supplies to the ECU 5 a high level signal when the air-fuel ratio of the mixture is rich, and a low level signal when it is lean.

An atmospheric pressure (PA) sensor 18 is arranged in the engine at a proper location thereof for supplying the ECU 5 with an electric signal indicative of the atmospheric pressure PA sensed thereby.

The ECU 5 is comprised of an input circuit **5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as the "the CPU") 5b, memory means 5c formed of a ROM storing various operational programs which are executed by the CPU 5b, and various maps and tables, referred to hereinafter, and a RAM for storing results of calculations therefrom, etc., an output circuit 5d which outputs driving signals to the fuel injection valves 6 and the spark plugs 13**, respectively.

The CPU 5b operates in response to the above-mentioned signals from the sensors to determine operating conditions in which the engine 1 is operating, such as an air-fuel ratio feedback control region and open-loop control regions, and calculates, based upon the determined engine operating conditions, the valve opening period or fuel injection period TOUT over which the fuel injection valves 6 are to be opened by the use of the following equation (1) when the engine is in a basic operating mode, and by the use of the following equation (2) when the engine is in a starting mode, in synchronism with generation of TDC signal pulses, and stores the results of calculation into the memory means 5c (RAM):

$$TOUT=TiM\times KCMDM\times KLAF\times K1+K2 \quad (1)$$

$$TOUT=TiCR\times K3+K4 \quad (2)$$

where TiM represents a basic fuel injection period applied when the engine is in the basic operating mode, which, specifically, is determined according to the engine rotational speed NE and the intake pipe absolute pressure PBA. A TiM map for determining a value of TiM is stored in the memory means 5c (ROM).

TiCR represents a basic fuel injection period applied when the engine is in the starting mode, which is determined according to the engine rotational speed NE and the intake pipe absolute pressure PBA, similarly to TiM. A TiCR map for determining a value of TiCR is stored in the memory means 5c (ROM), as well.

KCMDM represents a modified desired air-fuel ratio coefficient, which is set based on a desired air-fuel ratio coefficient KCMD determined based on operating conditions of the engine, and an air-fuel ratio correction value ΔKCMD determined based on an output from the O2 sensor 17 during the O2 feedback processing, as will be described later. On other occasions, KCMDM is set to or held at predetermined values at respective steps of the programs described below.

KLAF represents an air-fuel ratio correction coefficient, which is set during the air-fuel ratio feedback control such that the air-fuel ratio detected by the LAF sensor 16 becomes equal to a desired air-fuel ratio set by the KCMDM value, and set during the open-loop control to predetermined values depending on operating conditions of the engine.

K1 and K3 represent other correction coefficients and K2 and K4 represent correction variables. The correction coefficients and variables are set depending on operating conditions of the engine to such values as will optimize operating characteristics of the engine, such as fuel consumption and accelerability.

Figure 2:
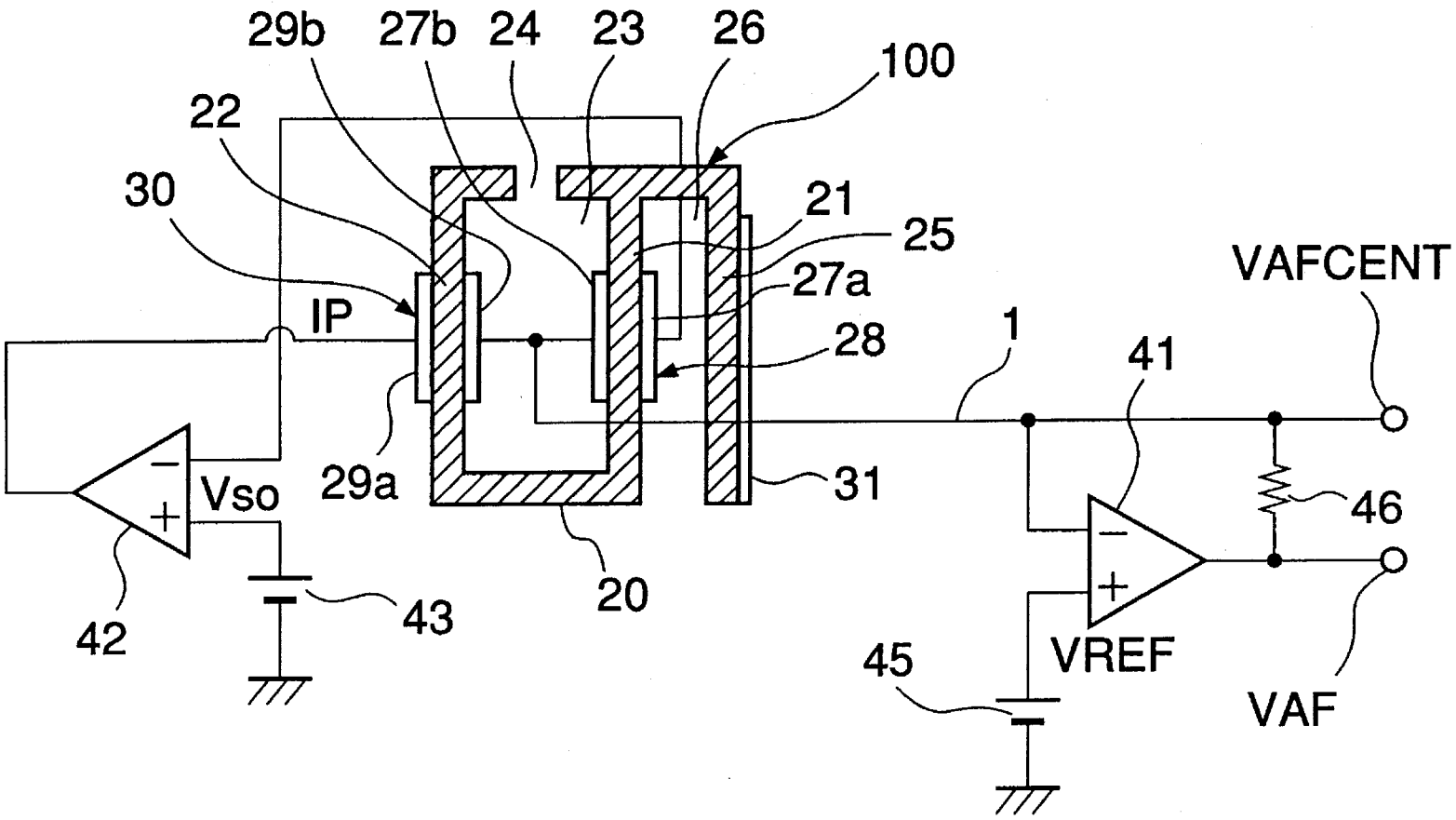
FIG. 2 is a diagram showing an example of the construction of a LAF sensor appearing in FIG. 1.

Referring next to FIG. 2, there is illustrated the construction of the LAF sensor 16 and its associated components.

Figure 3:
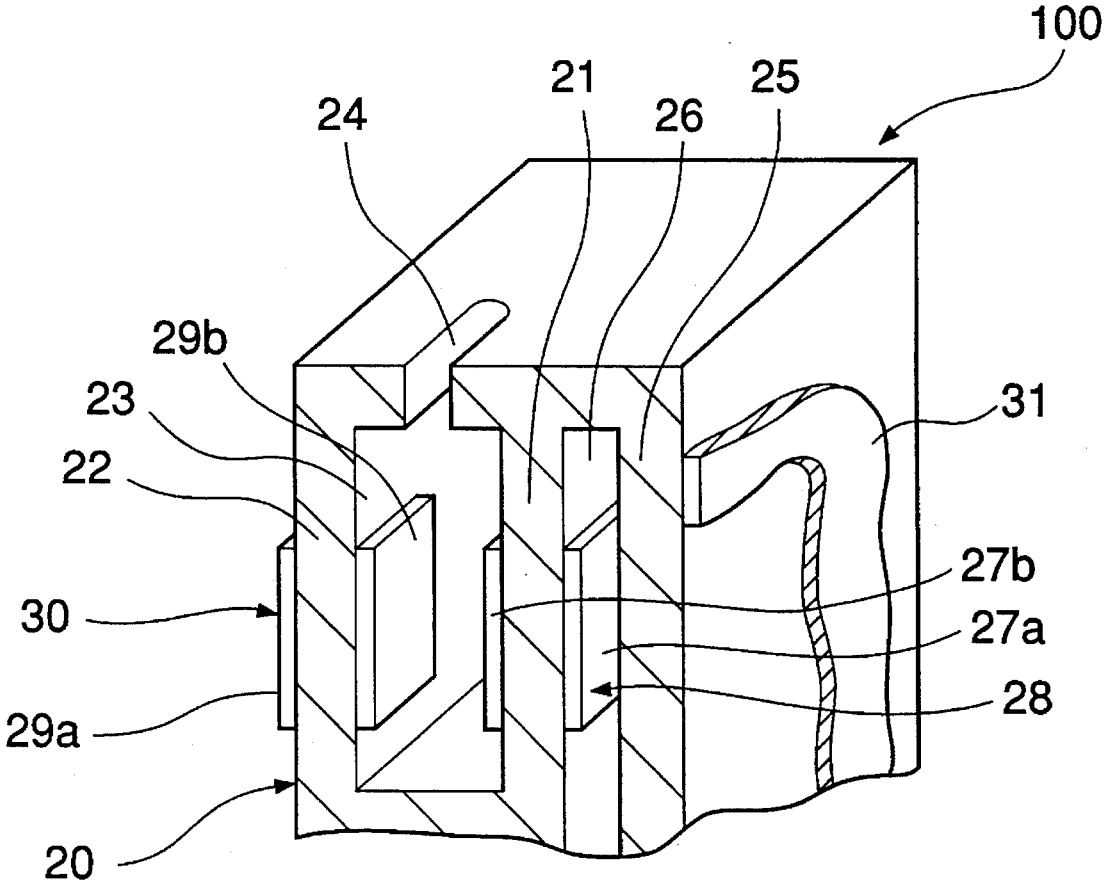
FIG. 3 is a perspective view, partly in section, showing the LAF sensor.

In the figure, reference numeral 100 designates a body (sensor element section) of the LAF sensor 16. The sensor body 100 is arranged within the exhaust pipe 14. As shown in detail in FIG. 3, the sensor body 100 is in the form of a rectangular parallel piped, and comprised of a basic body 20 formed of a solid electrolytic material having oxygen-ion conductivity (e.g. zirconium dioxide ($ZrO_2$)). The basic body 20 of the sensor body 100 has first and second walls 21, 22 extending parallel with each other, between which a gas diffusion chamber (diffusion restriction region) 23 serving as a gas diffusion-limiting zone is defined.

The gas diffusion chamber 23 is communicated with the interior of the exhaust pipe 14 of the engine through a slit 24 which is disposed such that exhaust gases in the exhaust pipe can be guided into the gas diffusion chamber 23 through the slit 24. An air reference chamber 26 to be supplied with air as a reference gas is defined between the first wall 21 and an outer wall 25 disposed adjacent the first wall 21 and extending parallel therewith.

To detect oxygen concentration within the gas diffusion chamber 23, a couple of electrodes 27a, 27b formed of platinum (Pt) are mounted on opposite side surfaces of the first wall 21, which cooperate with the first wall 21 to form a cell element (sensing cell) 28, while a couple of electrodes 29a, 29b are similarly mounted on opposite side surfaces of the second wall 22, which cooperate with the second wall 22 to form an oxygen-pumping element (pumping cell) 30.

A heater (heating element) 31 is provided on an outer side surface of the outer wall 25, for heating the cell element 28 and the oxygen-pumping element 30 to activate them.

As shown in FIG. 2, the electrodes 27b and 29b which are located on the gas diffusion chamber side are connected with each other, and are connected to an inverting input terminal of an operational amplifier 41 through a line L.

On the other hand, the other or outer electrode 27a of the cell element 28 is connected to an inverting input terminal of a differential amplifier circuit 42. The differential amplifier circuit 42 forms voltage-applying means together with a reference voltage source 43 connected to a non-inverting input terminal thereof for applying to the oxygen-pumping element 30 a voltage corresponding to the difference between a voltage (cell element voltage) developed between the electrodes 27a and 27b of the cell element (exactly, in the FIG. 2 embodiment, the sum of a voltage on the line L and the cell element voltage) and a reference voltage VSO from the reference voltage source 43.

In the present embodiment, the reference voltage VSO of the reference voltage source 43 is normally set to a value of the sum of the cell element voltage developed across the cell element 28 when the actual air-fuel ratio of a mixture supplied to the engine is equal to the stoichiometric air-fuel ratio, e.g. 0.45 volts and a predetermined reference voltage VREF, hereinafter referred to, applied to a non-inverting input terminal of the operational amplifier 41.

The differential amplifier circuit 42 has an output terminal thereof connected to the outer electrode 29a of the oxygen-pumping element 30 remote from the gas diffusion chamber 23. The voltage applied to the outer electrode 29a of the oxygen-pumping element 30 changes as the output from the differential amplifier circuit 42 changes into a positive level or a negative level in response to whether the supply air-fuel ratio (the air-fuel ratio of the mixture supplied to the engine) changes to a lean side or a rich side with respect to the stoichiometric air-fuel ratio. Further, responsive to each of the changes of the output from the differential amplifier circuit 42, there occurs a change in the direction (positive or negative) of the pumping current IP flowing through a pumping current-detecting resistance 46, hereinafter referred to, via the oxygen-pumping element 30 and the line L.

The non-inverting input terminal of the operational amplifier circuit 41 is connected to a reference voltage source 45 to be supplied with the predetermined reference voltage VREF therefrom. The pumping current-detecting resistance 46 for detecting the pumping current IP is connected between an output terminal of the operational amplifier circuit 41 and the line L, i.e. the inverting input terminal of the operational amplifier circuit 41. In other words, the resistance 46 is interposed in a negative feedback path of the operational amplifier circuit 41.

With the above described construction of the LAF sensor, when no pumping current IP flows through the line L, i.e. when IP=0, a voltage IPV at the output terminal of the operational amplifier circuit 41 (i.e. voltage at one end of the pumping current-detecting resistance 46) is equal to the redetermined reference voltage VREF set by the reference voltage source 45, and at the same the central voltage VAFCENT at the inverting input terminal of the operational amplifier circuit 41, i.e. the voltage at the other end of the pumping current-detecting resistance 46 or a potential on the line L is substantially equal to the predetermined reference voltage VREF, since IP=0.

Moreover, even when the pumping current IP flows, while varying in magnitude with the supply air-fuel ratio as it varies in its rich region or lean region, as will be referred to hereinbelow, it is possible to cause the voltage at the other end of the pumping current-detecting resistance 46 connected to the line L to assume a value substantially equal to the voltage at the non-inverting input thermal of the circuit 41, i.e. the predetermined reference voltage VREF, irrespective of changes in the pumping current IP.

As describe above, the voltage on the line L, i.e. the voltage VAFCENT at the other end of the pumping current-detecting resistance 46 exhibits a constant voltage characteristic such that it is maintained substantially equal to the predetermined reference voltage VREF, irrespective of presence or absence of the pumping current or variation in magnitude of a positive or negative value thereof. On the other hand, the voltage VAF at the one end of the pumping current-detecting resistance 46 connected to the output terminal of the operational amplifier circuit 41 varies with the direction (positive or negative) of flow and magnitude of the pumping current IP. Therefore, the voltage VAFCENT forms a central value (central voltage) for detecting the current flowing through the oxygen-pumping element 30 by the voltage developed across the pumping current-detecting resistance 46 to thereby determine the air-fuel ratio based on the detected value of the pumping current IP. The output voltage VAF of the operational amplifier circuit 41 and the voltage VAFCENT on the line L detected at respective ends of the pumping current-detecting resistance 46 are supplied to the input circuit **5*a* of the ECU 5**.

Thus, the input circuit **5*a* of the ECU 5 is supplied with the central voltage VAFCENT and the output voltage VAF, in performing the air-fuel ratio-determining processing based on the pumping current IP flowing through the LAF sensor 16**.

The oxygen concentration is detected by the LAF sensor when the air-fuel ratio is in the rich and lean regions, in the following manner:

Exhaust gases are introduced into the gas diffusion chamber 23 through the slit 24 with operation of the engine. This causes a difference in oxygen concentration between the gas diffusion chamber and the air reference chamber 26 into which air is introduced. Consequently, a voltage corresponding to the difference is developed between the electrodes **27*a* and 27*b* of the cell element 28, which is added to the line L voltage VAFCENT, and the resulting sum voltage is applied to the inverting input terminal of the differential amplifier circuit 42. When the supply air-fuel ratio is on the lean side, the voltage between the electrodes 27*a* and 27*b* of the cell element 28 lowers, while the line L voltage VAFCENT is maintained at the reference voltage VREF, so that the sum of the voltage between the electrodes 27*a* and 27*b* and the voltage VAFCENT becomes lower than the reference voltage VSO. Thus, the output level of the differential amplifier circuit 42 becomes positive, and the positive level voltage is applied to the oxygen-pumping element 30. When the positive level voltage is thus applied to the oxygen-pumping element 30 while it is activated, oxygen present within the gas diffusion chamber 23 is ionized, whereby the resulting ions move through the electrode 29*b*, the second wall 22, and the electrode 29*a* to be emitted therefrom as oxygen gas or pumped out of the LAF sensor 16. Accordingly, the pumping current IP flows from the electrode 29*a* to the electrode 29*b* and flows through the pumping current-detecting resistance 46 via the line L. At this time, the pumping current IP flows through the resistance 46 from the line L to the output side of the operational amplifier circuit 41**.

On the other hand, when the air-fuel ratio is on the rich side, the sum of the voltage between the electrodes **27*a* and the 27*b* of the cell element 28 and the line L voltage VAFCENT becomes higher than the reference voltage VSO, so that the output level of the differential amplifier circuit 42 becomes negative. Consequently, reversely to the above described action, external oxygen is pumped into the gas diffusion chamber 23 through the oxygen-pumping element 30, and simultaneously the pumping current IP flows from the electrode 29*b* to the electrode 29*a* and flows through the pumping current-detecting resistance 47**, in the direction of flow of the pumping current IP reverse to that in the above case.

When the actual air-fuel ratio is equal to the stoichiometric air-fuel ratio, the sum of the voltage between the electrodes **27*a* and 27*b* of the cell element 28** and the line L voltage VAFCENT becomes equal to the reference voltage VSO, so that neither the pumping-in nor pumping-out of oxygen is effected, whereby no pumping current flows (that is, the pumping current IP is zero).

As described above, since the pumping-in and out of oxygen and hence the pumping current IP are controlled so as to maintain the oxygen concentration in the gas diffusion chamber 23 at a constant level, the pumping current IP assumes a value proportional to the oxygen concentration of the exhaust gases so long as the actual air-fuel ratio is on the lean and rich sides.

Next, there will be described how the air-fuel ratio control system according to the invention carries out the air-fuel ratio feedback control by the CPU **5*b*** thereof.

Figure 4:
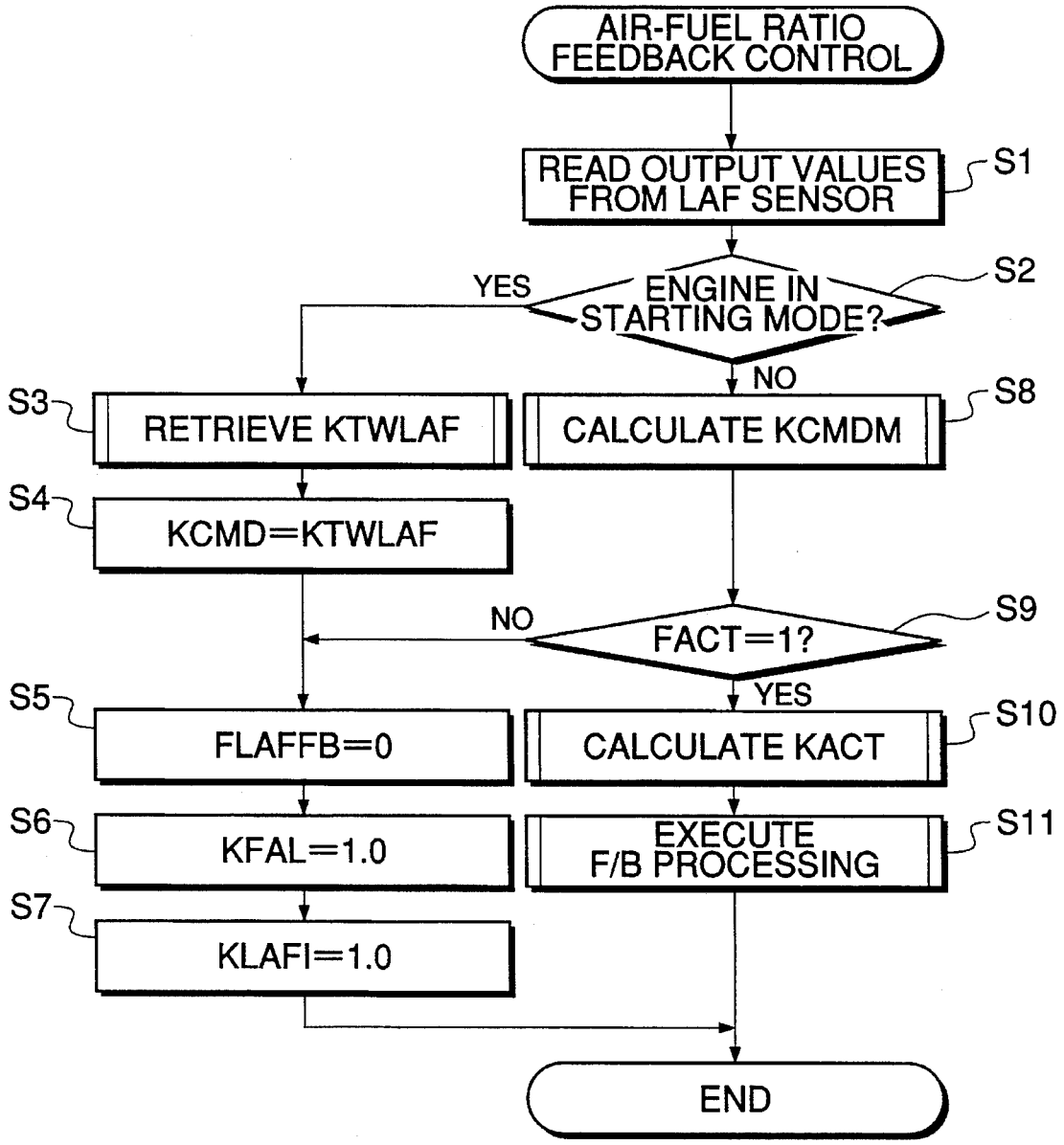
FIG. 4 is a flowchart showing a main routine for carrying out air-fuel ratio feedback control according to the invention.

FIG. 4 shows a main routine for carrying out the air-fuel ratio feedback control.

First, at a step S1, output values VAF and VAFCENT from the LAF sensor 16 are read in. Then at a step S2, it is determined whether or not the engine is in the starting mode. The determination of the starting mode is carried out by determining whether or not a starter switch, not shown, of the engine has been turned on, and at the same time the engine rotational speed NE is below a predetermined value (cranking rotational speed).

If the answer to the question of the step S2 is affirmative (YES), i.e. if the engine is in the starting mode, which implies that the engine temperatures is low, and hence a value of a desired air-fuel ratio coefficient KTWLAF suitable for low engine temperature is determined at a step S3 by retrieving a KTWLAF map according to the engine coolant temperature TW and the intake pipe absolute pressure PBA, and the determined KTWLAF value is set to the desired air-fuel ratio coefficient KCMD at a step S4. Then, a flag FLAFFB is set to "0" at a step S5 to inhibit the air-fuel ratio feedback control, and the air-fuel ratio correction coefficient KLAF and an integral term (I term) KLAFI thereof are both set to 1.0 at respective steps S6 and S7, followed by terminating the program.

On the other hand, if the answer to the question of the step S2 is negative (NO), i.e. if the engine is in the basic mode, the modified desired air-fuel ratio coefficient KCMDM is determined at a step S8 according to a KCMDM-determining routine, described hereinafter with reference to FIG. 5, and then it is determined at a step S9 whether or not a flag FACT is equal to "1" in order to judge whether the LAF sensor 16 has been activated. The determination as to whether the LAF sensor 16 has been activated is carried out according to another routine, not shown, which is executed by background processing, in which when the difference between the output voltage VAF from the LAF sensor 16 and the central voltage VAFCENT from same is smaller than a predetermine value (e.g. 0.4V), for instance, it is determined that the LAF sensor 16 has been activated.

Then, if the answer to the question of the step S9 is negative (NO), the program proceeds to the step S5, whereas if the answer to the question of the step S9 is affirmative (YES), i.e. if the LAF sensor 16 has been activated, the program proceeds to a step S10, where an equivalent ratio KACT (14.7/(A/F)) of the air-fuel ratio detected by the LAF sensor 16 (hereinafter referred to as "the actual air-fuel ratio coefficient") is calculated. The actual air-fuel ratio coefficient KACT is corrected, in calculation thereof, based on the intake pipe absolute pressure PBA, the engine rotational speed NE, and the atmospheric pressure PA, in view of the fact that the pressure of exhaust gases varies with these operating parameters of the engine. Specifically, the actual air-fuel ratio coefficient KACT is determined by executing a KACT-determining routine, described hereinafter with reference to FIG. 11.

Then, at a step S11, a feedback processing routine is executed, followed by terminating the program. More specifically, if predetermined feedback control conditions are not satisfied, the flag FLAFFB is set to "0" to inhibit execution of the air-fuel ratio feedback control, whereas if the predetermined feedback control conditions are satisfied, the flag, FLAFFB is set to "1", and the air-fuel ratio correction coefficient KLAF is calculated, while outputting instructions for execution of the air-fuel ratio feedback control, followed by terminating the program.

Figure 5:
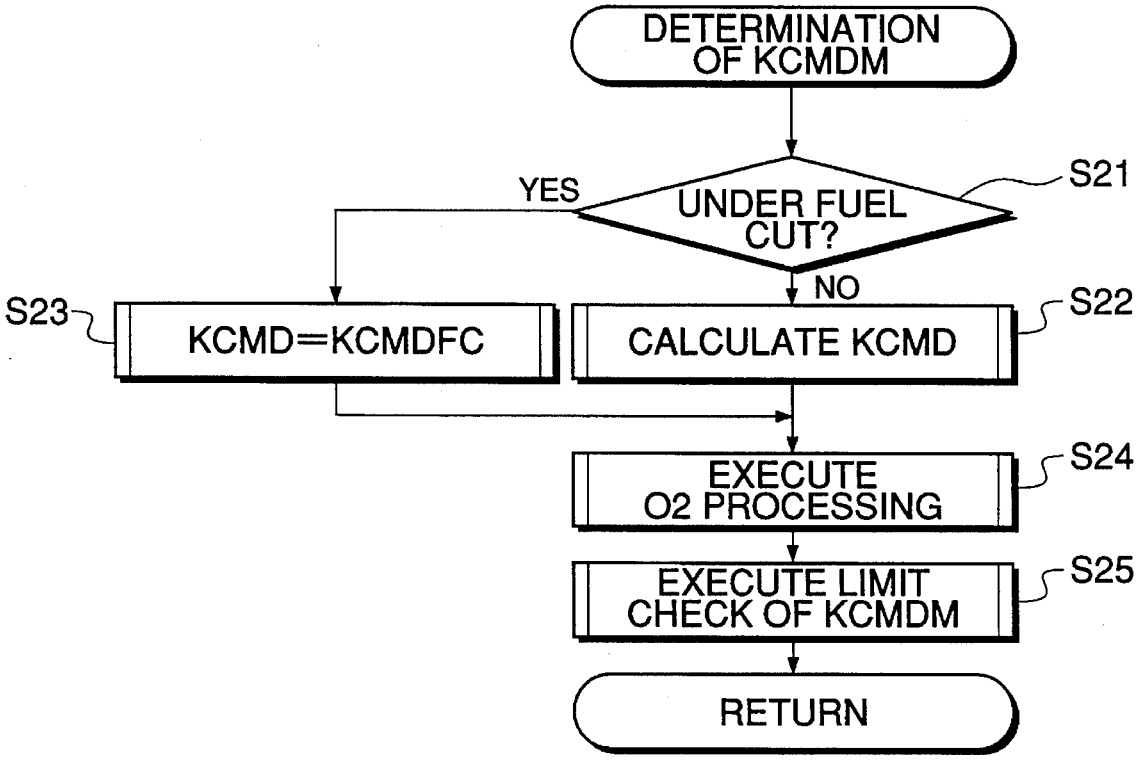
FIG. 5 is a flowchart showing a KCMDM-determining routine.

FIG. 5 shows details of the aforementioned KCMDM-determining routine executed at the step S8 in FIG. 2, which is executed in synchronism with generation of TDC signal pulses.

First, at a step S21, it is determined whether or not the engine is under fuel cut. The determination of fuel cut is carried out based on the engine rotational speed NE and the valve opening θTH of the throttle valve 3', and more specifically determined by a fuel cut-determining routine, not shown.

If the answer to the question of the step S21 is negative (NO), i.e. if the engine is not under fuel cut, the program proceeds to a step S22, where the desired air-fuel ratio coefficient KCMD is determined. The desired air-fuel ratio coefficient KCMD is normally read from a KCMD map according to the engine rotational speed NE and the intake pipe absolute pressure PBA, which map is set such that predetermined KCMD map values correspond to predetermined values of the engine rotational speed NE and those of the intake pipe absolute pressure PBA. When a vehicle on which the engine is installed is being started from standing position, or the engine is in a low temperature condition, or in a predetermined high load condition, a map value read is corrected to a suitable value, specifically by executing a KCMD-determining routine, not shown. The program then proceeds to a step S24.

On the other hand, if the answer to the question of the step S21 is affirmative (YES), the desired air-fuel ratio coefficient KCMD is set to a predetermined value KCMDFC (e.g. 1.0) at a step S23, and then the program proceeds to the step S24.

At the step S24, O2 processing is executed. More specifically, the desired air-fuel ratio coefficient KCMD is corrected based on the output from the O2 sensor 17 to obtain the modified desired air-fuel ratio coefficient KCMDM, under predetermined conditions, as will be described hereinafter.

Then, at the following step S25, a limit check of the modified desired air-fuel ratio coefficient KCMDM is carried out, followed by terminating the present subroutine to return to the main routine in FIG. 4. More specifically, the KCMDM value calculated at the step S24 is compared with predetermined upper and lower limit values KCMDMH and KCMDML, and if the KCMDM value is larger than the predetermined upper limit value KCMDMH, the former is corrected to the latter, whereas if the KCMDM value is smaller than the predetermined lower limit value KCMDML, the former is corrected to the latter.

Figure 6:
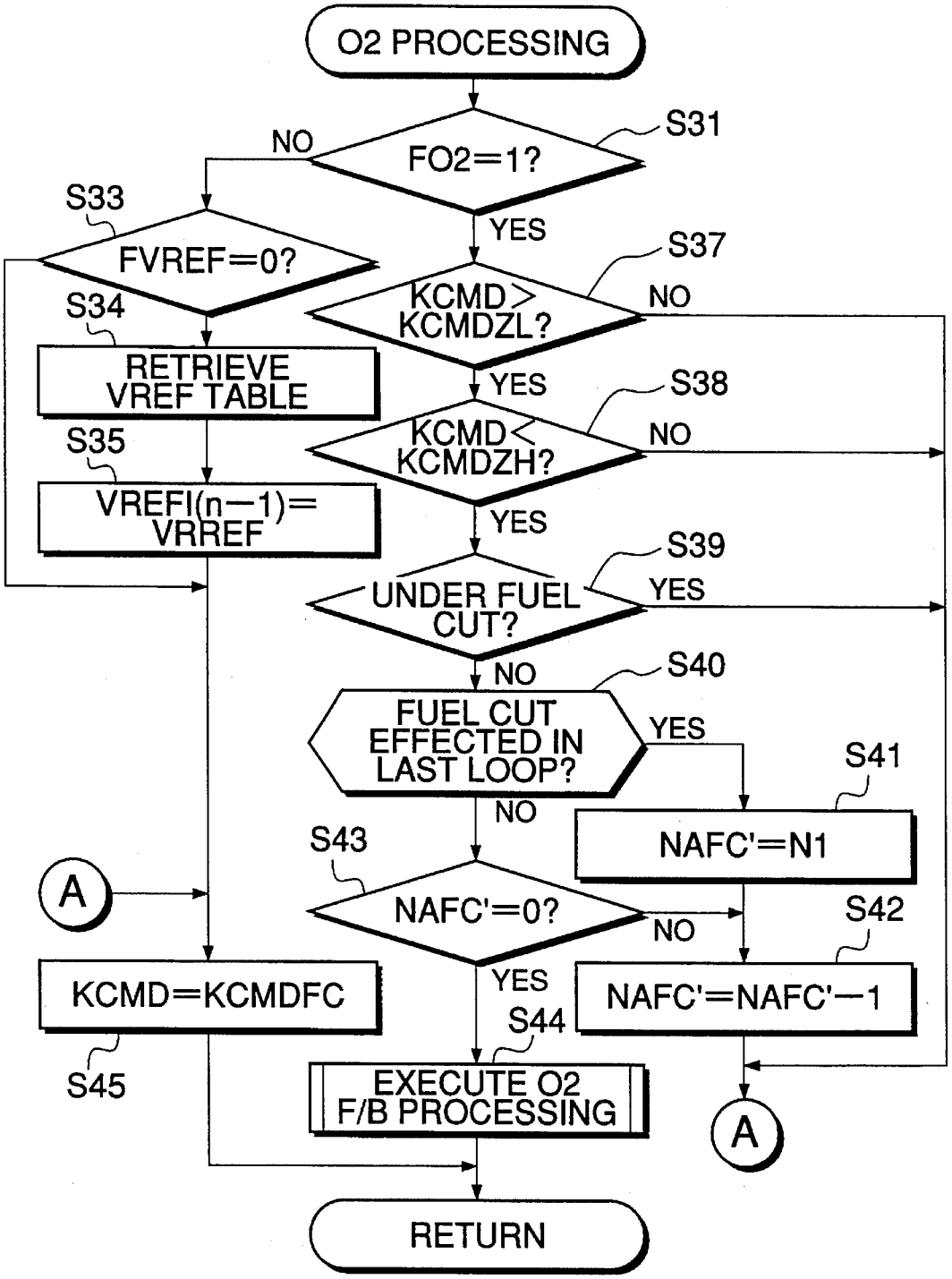
FIG. 6 is a flowchart showing an O2 processing routine.

FIG. 6 shows an O2 processing routine executed at the step S24 in FIG. 5, which is carried out in synchronism with generation of each TDC signal pulse.

First, at a step S31, it is determined whether or not a flag FO2 is equal to "1" to determine whether the O2 sensor 17 has been activated. The determination of activation of the O2 sensor 17 is carried out, specifically by executing an O2 sensor activation-determining routine shown in FIG. 7, by background processing.

Figure 7:
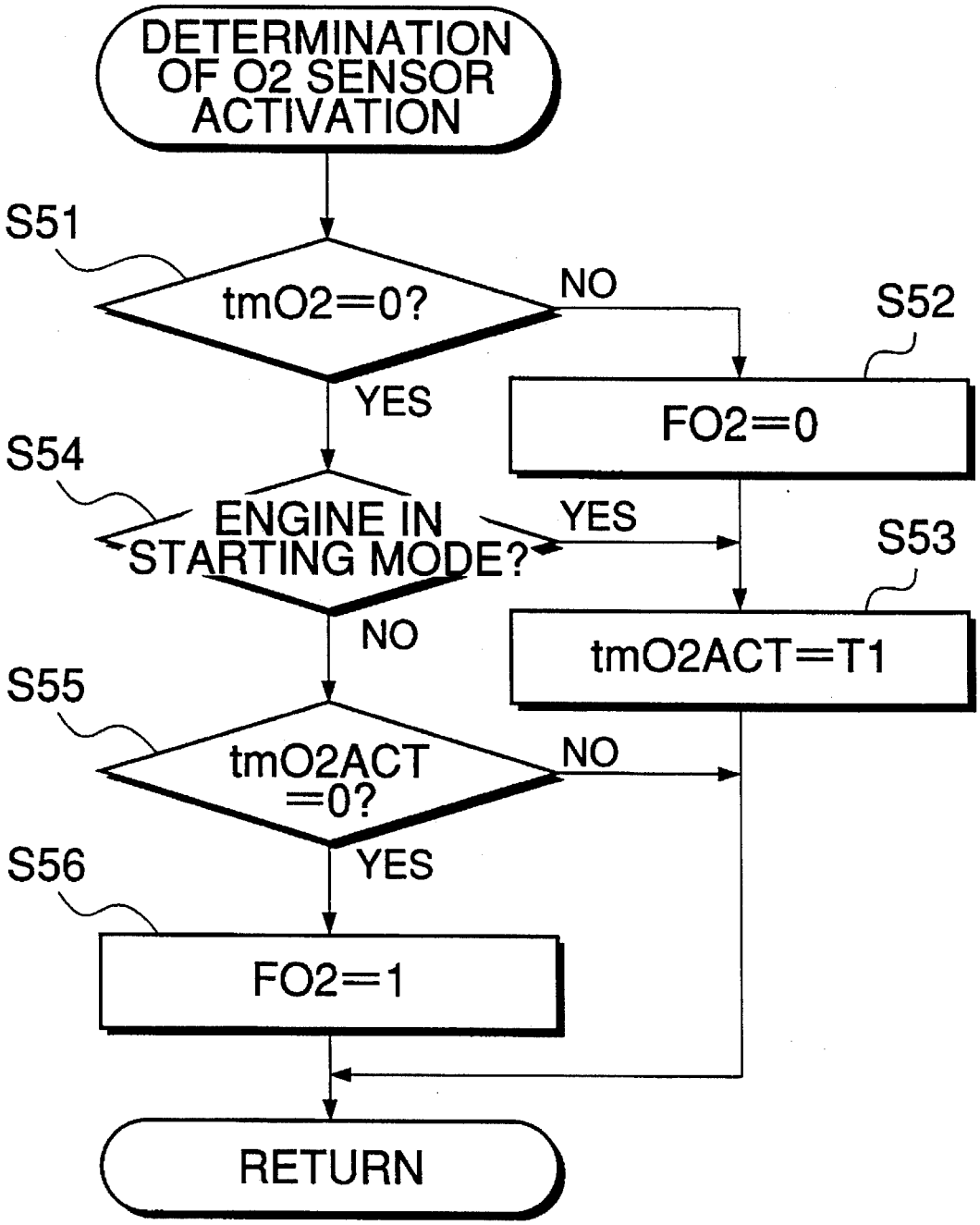
FIG. 7 is a flowchart showing an O2 sensor activation-determining routine for determining whether an O2 sensor has been activated.

Referring to FIG. 7, first at a step S51, it is determined whether or not the count value of an activation-determining timer tmO2, which is set to a predetermined value (e.g. 2.56 sec.) when an ignition switch, not shown, is turned on, is equal to "0". If the answer to this question is negative (NO), it is judged that the O2 sensor 17 has not been activated, so that the flag F02 is set to "0" at a step S52, and then an O2 sensor forcible activation timer tmO2ACT is set to a predetermined value T1 (e.g. 2.56 sec.) and started, at a step S53, followed by terminating the program.

On the other hand, if the answer to the question of the step S51 is affirmative (YES), it is determined at a step S54 whether or not the engine is in the starting mode. If the answer to this question is affirmative (YES), the program proceeds to the step S53.

If the answer to the question of the step S54 is negative (NO), the program proceeds to a step S55, where it is determined whether or not the count value of the forcible activation timer tmO2ACT is equal to "0". If the answer to this question is negative (NO), the present program is immediately terminated, whereas if the answer is affirmative (YES), it is judged that the O2 sensor 17 has been activated, so that the flag FO2 is set to "1" at a step S56, followed by terminating the program.

Thus, as a result of execution of the O2 sensor activation-determining routine shown in FIG. 7, if the answer to the question of the step 831 in FIG. 6 is negative (NO), i.e. if it is determined that the O2 sensor 17 has not been activated, the program proceeds to a step S33, where it is determined whether or not a flag FVREF is equal to "0" to thereby determine whether or not a desired reference value VREF2 of output voltage VO2 from the O2 sensor 17 has been set to an initial value thereof (hereinafter referred to as "the initial reference value") VRREF.

In the first loop, the answer to the question of the step 833 is affirmative (YES), i.e. the flag FVREP =0, indicating that the desired reference value VREF2 has not been set to the initial reference value VRREF, so that the program proceeds to a step 834, where a VRREF table stored in the memory means 5*c* (ROM) is retrieved to determine the initial reference value VRREF.

The VRREF table is set, e.g. such that table values VRREF are provided in a manner stepwise corresponding to predetermined values PA of the atmospheric pressure PA detected by the PA sensor 18. The initial reference value VRREF is determined by retrieving this table or by interpolation of retrieved values. In this connection, the initial reference value VRREP is set to a larger value as the atmospheric pressure PA assumes a higher value.

Then, at a step S35, the integral term (I term) VREFI(n-1) of the desired reference value VREF2 in the immediately preceding loop is set to the initial reference value VRREF, and the program proceeds to a step S45, where KCMDM is set to KCMD, followed by terminating the program to return to the KCMDM-determining routine shown in FIG. 5. In the following loops, the answer to the question of the step S33 is negative (NO), since the desired reference value VREF2 has already been set to the initial reference value VRREF as described above, so that the program skips over the steps S34 and S35 to the step S45, followed by terminating the program.

Further, if the answer to the question of the step S31 is affirmative (YES), it is judged that the O2 sensor 17 has been activated, and the program proceeds to a step S37, where it is determined whether or not the desired air-fuel ratio coefficient KCMD set at the step S22 or S23 in the FIG. 5 routine is larger than a predetermined lower limit value KCMDZL (e.g. 0.98). If the answer to this question is negative (NO), it means that the air-fuel ratio of the mixture is controlled to a value suitable for so-called lean burn, so that the program proceeds to the step S45, whereas if the answer is affirmative (YES), the program proceeds to a step S38, where it is determined whether or not the desired air-fuel ratio coefficient KCMD is smaller than a predetermined upper limit value KCMDZH (e.g. 1.13). If the answer to this question is negative (NO), it means that the air-fuel ratio of the mixture is controlled to a rich value, so that the program proceeds to the step S45, whereas if the answer is affirmative (YES), it means that the air-fuel ratio of the mixture is to be controlled to the stoichiometric value (A/F=14.7), so that the program proceeds to a step S39, where it is determined whether or not the engine is under fuel cut. If the answer to this question is affirmative (YES), the program proceeds to the step S45, whereas if the answer is negative (NO), it is determined at a step S40 whether or not the engine was under fuel cut in the immediately preceding loop. If the answer to this question is affirmative (YES), the count value NAFC' of a counter NAFC is set to a predetermined value N1 (e.g. 4) at a step S41, and the count value NAFC' is decreased by a decremental value of "1" at a step S42, followed by the program proceeding to the step S45.

On the other hand, if the answer to the question of the step S40 is negative (NO), the program proceeds to a step S43, where it is determined whether or not the count value NAFC' of the counter NAFC is equal to "0". If the answer to this question is negative (NO), the program proceeds to the step S42, whereas if the answer is affirmative (YES), it is judged that the fuel supply has been stabilized after termination of fuel cut, and the program proceeds to a step S44, where the O2 feedback processing is executed, followed by terminating the present routine to return to the FIG. 5 routine.

Figure 8:
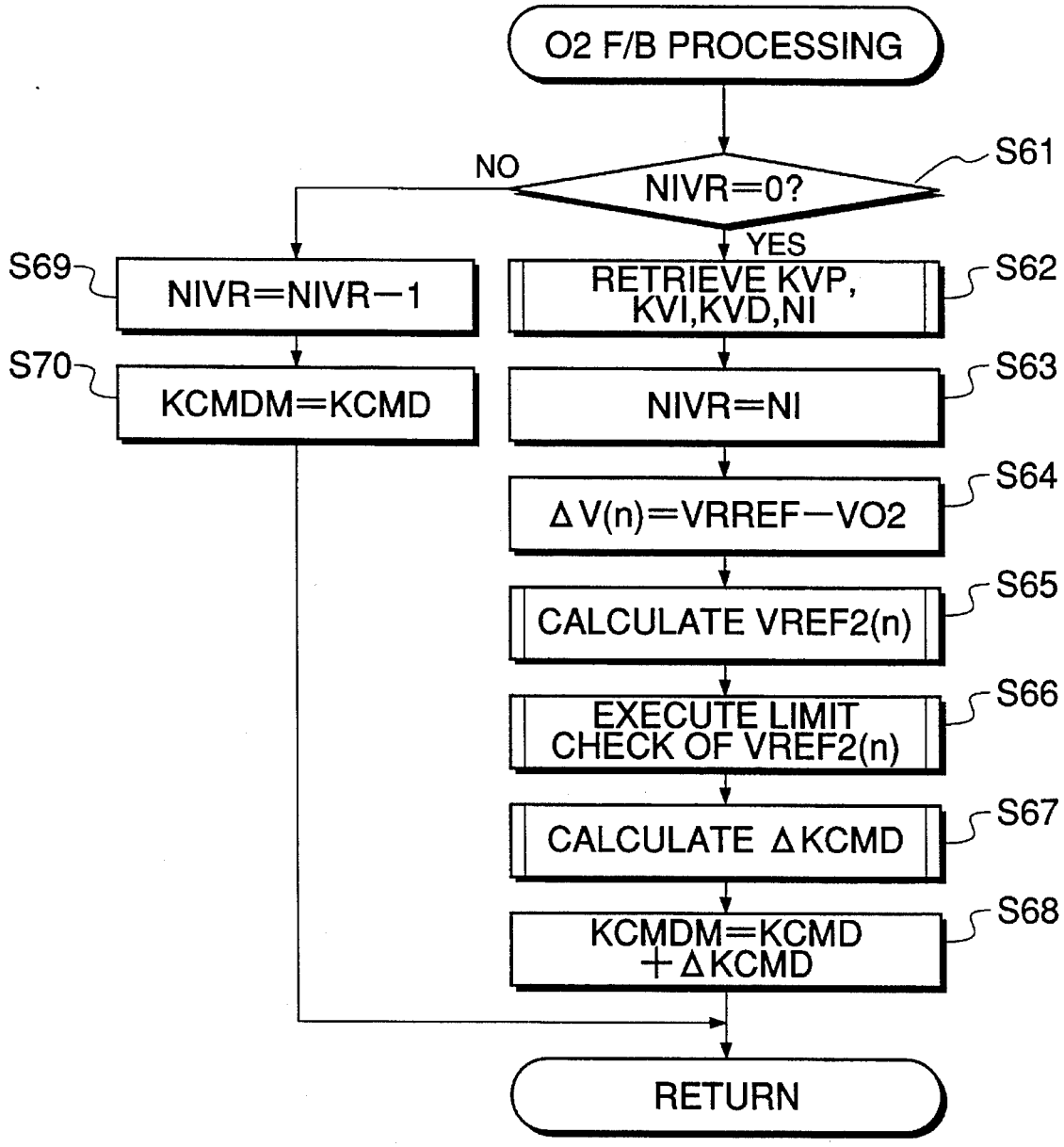
FIG. 8 is a flowchart showing an O2 feedback control routine executed by a first embodiment of the invention.

FIG. 8 shows an O2 feedback processing routine carried out at the step S44 of the FIG. 6 routine, which is executed in synchronism with generation of each TDC signal pulse.

First, at a step S61, it is determined whether or not a thinning-out variable NIVR is equal to "0". The thinning-out variable NIVR is a variable which is reduced to 0 whenever a thinning-out number NI, which is set depending on operating conditions of the engine as will be described later, of TDC signal pulses are generated. The answer to the question of the step S61 in the first loop is affirmative (YES), since the variable NIVR has not been set to the number NI, so that the program proceeds to a step S62.

If the answer to the question of the step S61 becomes negative in a subsequent loop, the program proceeds to a step S69, where a decremental value of 1 is subtracted from the thinning-out variable NIVR to update same, and then the program proceeds to a step S70, where KCMDM is set to KCMD, followed by terminating the present routine.

At the step S62, a KVP map, a KVI map, a KVD map, and an NI map are retrieved to determine control parameters indicative of rate of change in the O2 feedback control, i.e. a proportional term (P term) coefficient KVP, an integral term (I term) coefficient KVI, and a differential term (D term) coefficient KVD, and the aforementioned thinning-out number NI. The KVP map, the KVI map, the KVD map, and the NI map are set, e.g. such that predetermined map values for the respective coefficients KVP, KVI KVD and number NI are provided in a manner corresponding to regions defined by predetermined values of the engine rotational speed NE and predetermined values of the intake pipe absolute pressure PBA. These control parameters are determined by reading respective map values suitable for engine operating conditions or by interpolation of retrieved values. In addition, these KVP, KVI, KVD, and NI maps each consist of a plurality of sub-maps stored in the memory means 5*c* (ROM) to be selected for exclusive use depending on operating conditions of the engine, e.g. on whether the engine is in a normal operating condition, whether the engine has changed its operating mode, whether the engine is decelerating, etc., so that the optimum map values can be determined.

Then, at a step S63, the thinning-out variable NIVR is set to the value or number NI determined at the step S62, and the program proceeds to a step S64 where there is calculated a difference ΔV(n) between the initial reference value VRREF determined at the step S34 of the FIG. 6 routine and the output voltage VO2 from the O2 sensor 17 detected in the present loop.

Then, at a step S65, desired values VREFP(n), VREFI(n), and VREFD(n) for the respective correction terms, i.e. P term, I term, and D term, are calculated by the use of the following equations (3) to (5):

$$VREFP(n)=iV(n)\times KVP \quad (3)$$

$$VREFI(n)=VREF2+AV(n)\times \mathrm{KVI} \quad (4)$$

$$VREFD(n)=(AV(n)-\Delta V(n-1))\times KVD \quad (5)$$

and then these desired values are added up by the use of the following equation (6):

$$VREF2(n)=VREFP(n)+VREFI(n)+VREFD(n) \quad (6)$$

to determine the desired reference value VREF2(n) of the output voltage V02 from the O2 sensor 17 used in the O2 feedback control.

Figure 9:
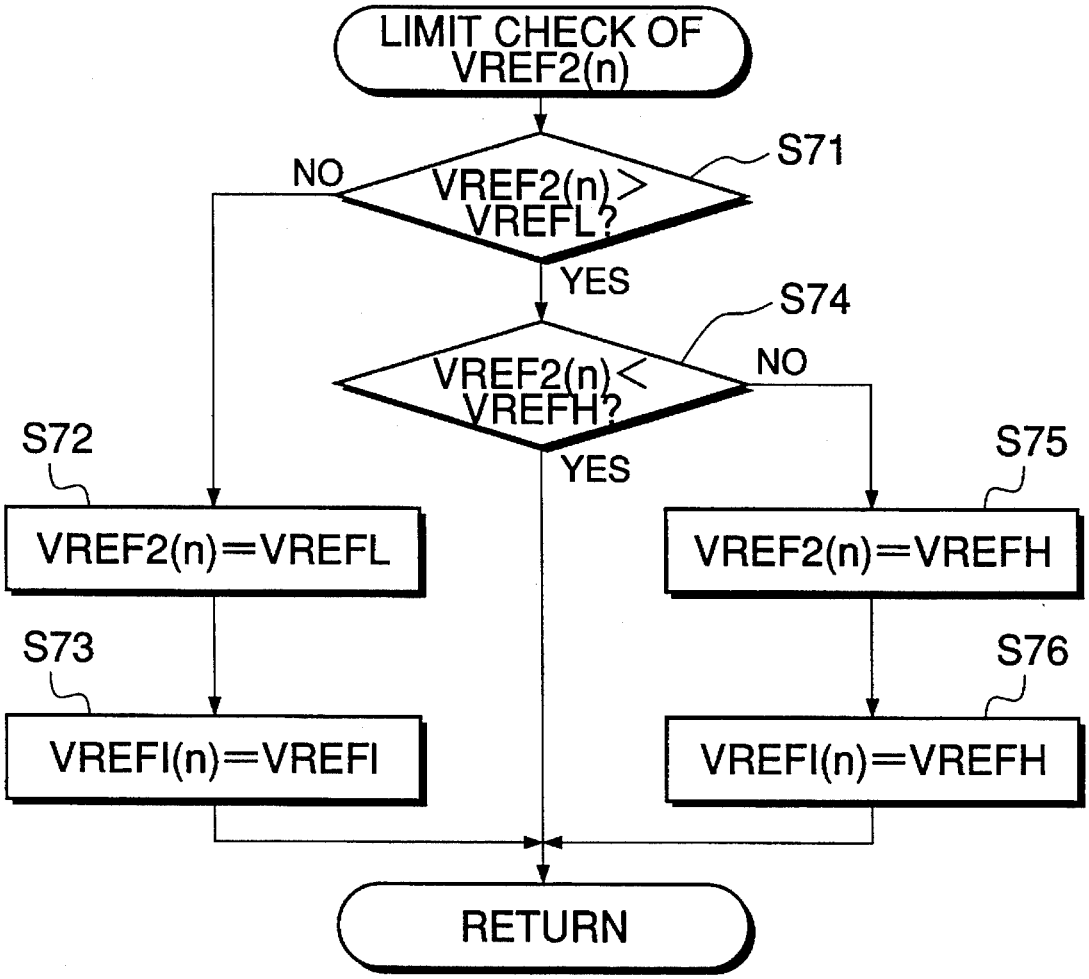
FIG. 9 is a flowchart showing a VREF2 (n) limit check routine.

Then, at a step S66, a limit check of the desired reference value VREF2(n) determined at the step S68 is carried out. FIG. 9 shows a routine for the limit check, which is executed in synchronism with generation of each TDC signal pulse.

First, at a step S71, it is determined whether or not the desired reference value VREF2(n) is larger than a predetermined lower limit value VREFL (e.g. 0.2V). If the answer to this question is negative (NO), the desired reference value VREF2(n) and the I term desired reference value VREF21(n) are set to the predetermined lower limit value VREFL at respective steps S72 and S73, followed by terminating this program.

On the other hand, if the answer to the question of the step S71 is affirmative (YES), it is determined at a step S74 whether or not the desired reference value VREF2(n) is lower than a predetermined higher limit value VREFH (e.g. 0.8V). If the answer to this question is affirmative (YES)) it means that the desired reference value VREF2(n) falls in a range defined by the predetermined upper and lower limit values VREFH and VREFL, so that the present routine is terminated without modifying the VREF2(n) value determined at the step S68, whereas if the answer to the question of the step S74 is negative (NO), the desired reference value VREF2(n) and the I term desired reference value VREF2I(n) are set to the predetermined upper limit value VREFH at respective steps S75 and S76, followed by terminating this routine.

Thus, the limit check of the desired reference value VREF2(n) is terminated, and then the program returns to a step S87 of the FIG. 8 routine, where the air-fuel ratio correction value ΔKCMD is determined.

Figure 10:
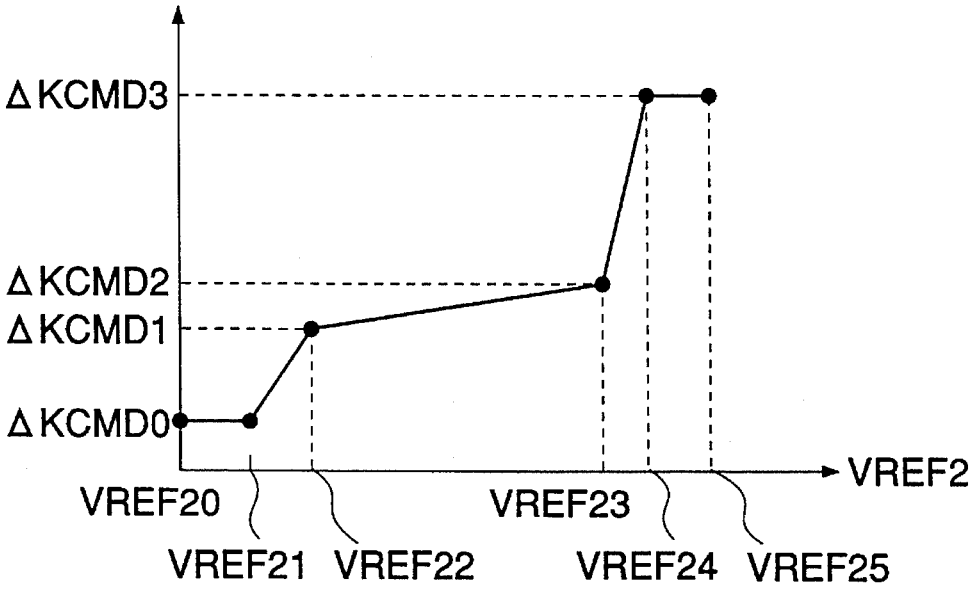
FIG. 10 shows a ΔKCMD table.

The air-fuel ratio correction value ΔKCMD is determined e.g. by retrieving a ΔKCMD table shown in FIG. 10. The "KCMD table is set such that table values ΔKCMD0 to ΔKCMD3 correspond to predetermined values VREF20 to VREF25 of the desired reference value VREF2. The air-fuel ratio correction value ΔKCMD is determined by reading from the ΔKCMD table, or interpolation of retrieved values. As is clear from FIG. 10, the ΔKCMD value is generally set to a larger value as the desired reference value VREF2(n) assumes a larger value. Further, since the VREF2 value has been subjected to the limit check at the step S66, the air-fuel ratio correction value ΔKCMD is also set to a value in a range defined by predetermined upper and lower limit values.

Then, at a step S68, the air-fuel ratio correction value ΔKCMD is added to the desired air-fuel ratio correction coefficient KCMD determined at the step S22 of the FIG. 5 routine to calculate the modified desired air-fuel ratio coefficient KCMDM (equivalent to the stoichiometric air-fuel ratio in the present case), followed by terminating this routine.

Figure 11:
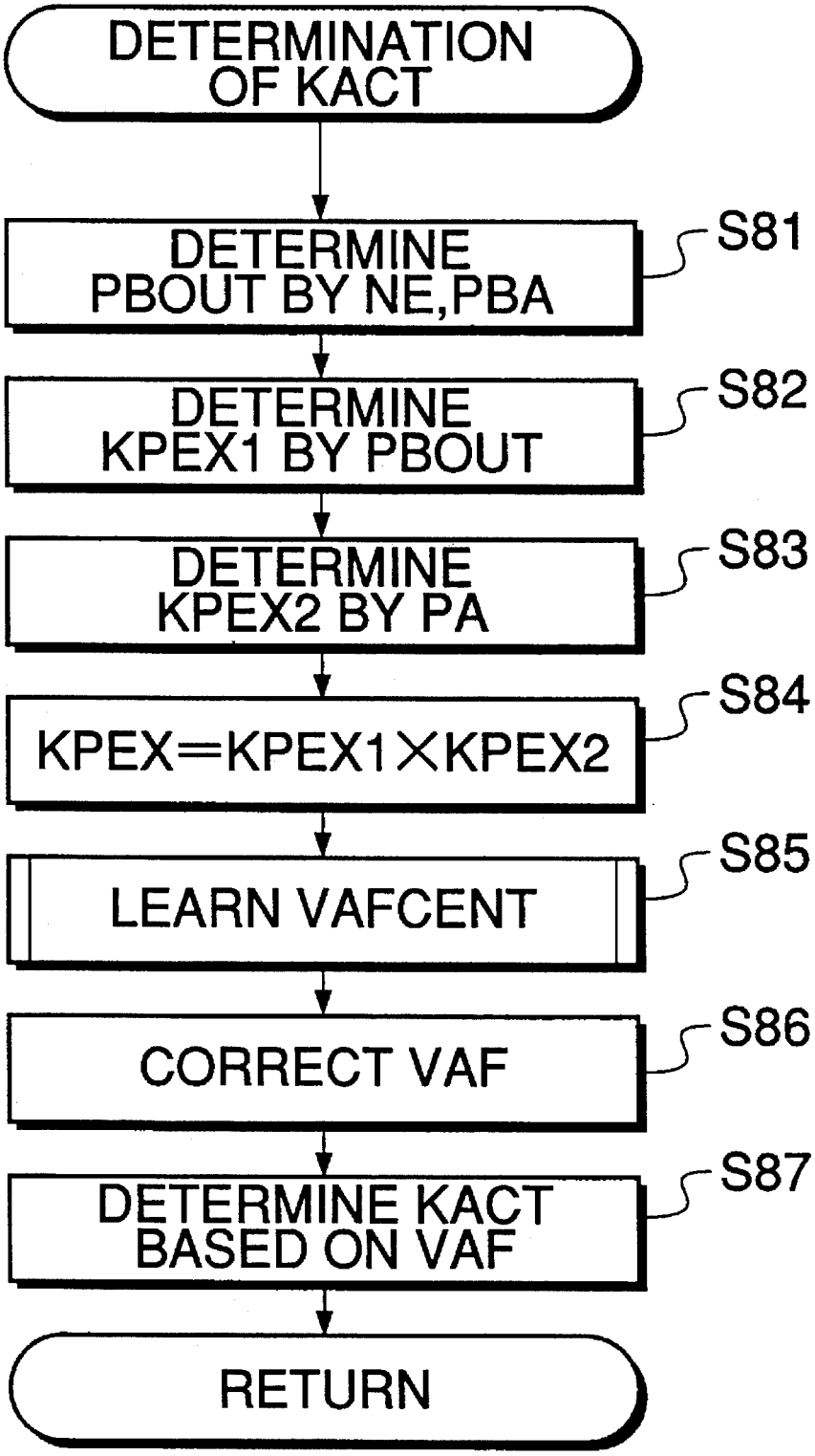
FIG. 11 is a flowchart showing a KACT-determining routine.

FIG. 11 shows the KACT-determining routine executed at the step S10 of the FIG. 4 main routine. This program is executed in synchronism with generation of each TDC signal pulse.

First, at a step S81, an exhaust pressure map stored in the memory means 5c is retrieved to determine the pressure of exhaust gases (exhaust pressure) PBOUT based on the engine rotational speed NE and the intake pipe absolute pressure PBA. The exhaust pressure map is set such that predetermined map values are provided in a manner corresponding to a plurality of operating regions of the engine determined by the engine rotational speed NE and the intake pipe absolute pressure PBA. The exhaust pressure PBOUT is determined by reading from the exhaust map or interpolation of retrieved values.

Figure 12:
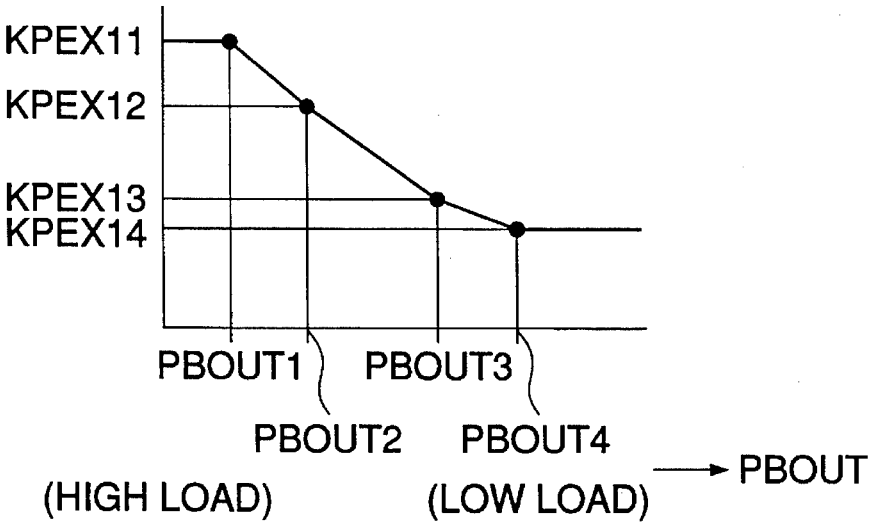
FIG. 12 shows a KPEX1 table.
Figure 13:
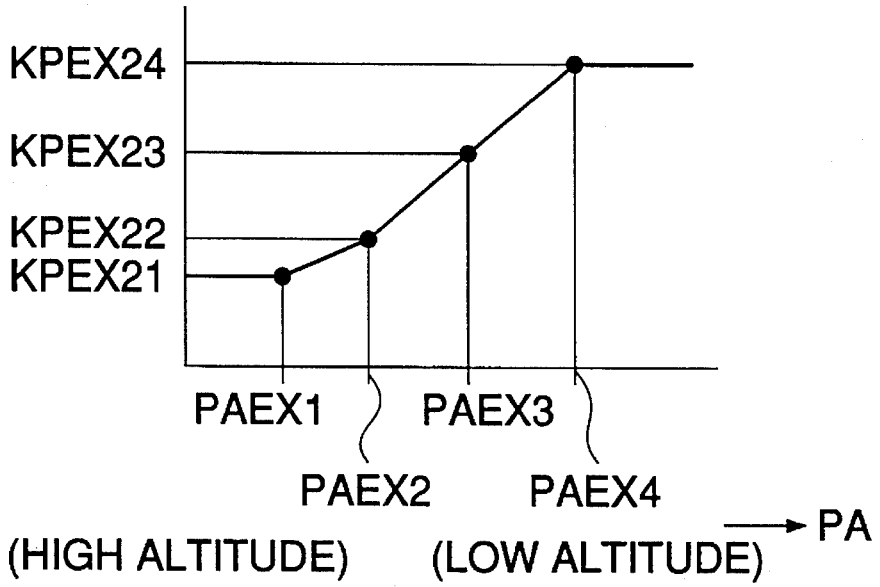
FIG. 13 shows a KPEX2 table.

At the following step S82, an exhaust pressure-dependent correction coefficient KPEX1 is determined by retrieving a KPEX1 table stored in the memory means 5c. The KPEX1 table is set, e.g. as shown in FIG. 12, such that table values KPEX11 to KPEX14 of the exhaust pressure-dependent correction coefficient KPEX1 correspond to predetermined values PBOUT1 to PBOUT4 of the exhaust pressure corresponding to high-to-low load conditions of the engine. The exhaust pressure-dependent correction coefficient KPEX1 is determined by reading from the KPEX1 table or interpolation of retrieved values. The exhaust pressure-dependent correction coefficient KPEX1 is set such that it increases as the exhaust pressure PBOUT decreases. Further, at a step S83, an atmospheric pressure-dependent correction coefficient KPEX2 is determined by retrieving a KPEX2 table stored in the memory means 5c, based on the atmospheric pressure PA detected by the PA sensor 18. The KPEX2 table is set, e.g. as shown in FIG. 13, such that table values KPEX21 to KPEX24 of the atmospheric pressure-dependent correction coefficient KPEX2 correspond to predetermined values PAEX1 to PAEX4 of the atmospheric pressure corresponding to high-to-low altitudes. The atmospheric pressure-dependent correction coefficient KPEX2 is determined by reading from the KPEX2 table or interpolation of retrieved values. The atmospheric pressure-dependent correction coefficient KPEX2 is set such that it increases as the atmospheric pressure PA increases.

Then, at a step S84, the final exhaust pressure-dependent correction coefficient KPEX is calculated by the use of the following equation (7):

$$KPEX=KPEX1\times KPEX2 \quad (7)$$

Then, at the following step S85, the central voltage VAFCENT output from the LAF sensor 16 is learned for correction of errors thereof. The learning of the central voltage VAFCENT is performed e.g. by executing a VAFCENT-correcting routine shown in FIG. 14. This routine is executed in synchronism with generation of TDC signal pulses.

Figure 14:
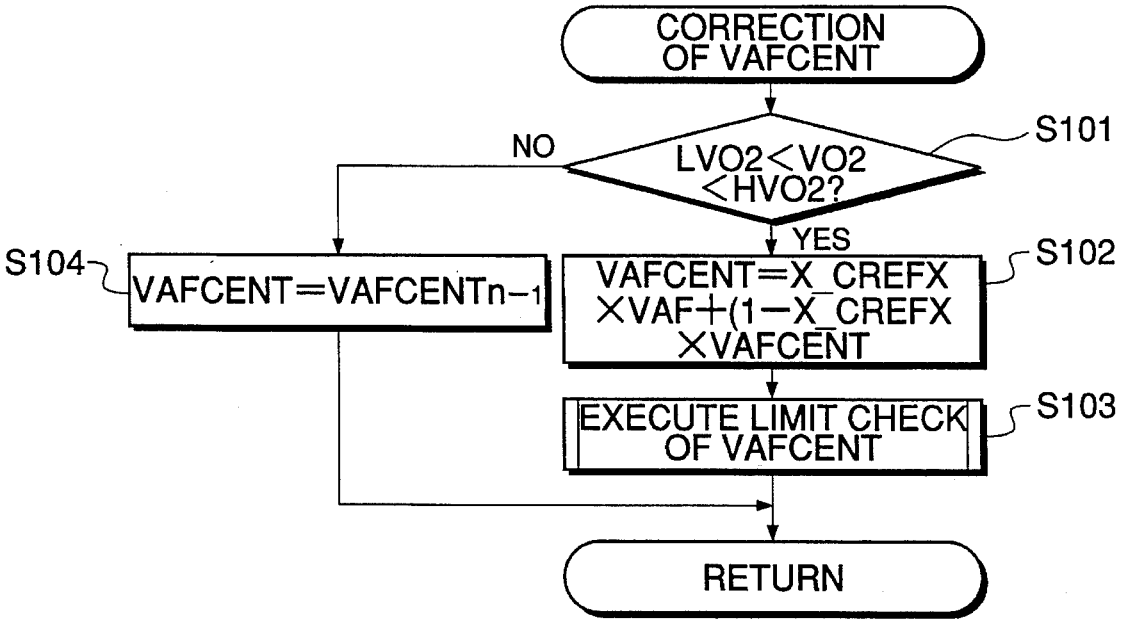
FIG. 14 is a flowchart showing a VAFCENT-correcting routine executed by the first embodiment.

Referring to FIG. 14, first, at a step S101, it is determined whether or not the output voltage VO2 from the O2 sensor 17 arranged downstream of the catalytic converter 15 is higher than a predetermined lower value LV02 (e.g. 0. 3 volts) and at the same time lower than a predetermined higher value HVO2 (e.g. 0.6 volts), i.e. whether the output voltage V02 is within a range in which the maximum conversion efficiency (purifying efficiency) of the catalytic converter 15 is obtained. If the answer to this question is affirmative (YES), i.e. if the output voltage VO2 from the O2 sensor 17 falls within the range of LVO2 - HVO2, the program proceeds to a step S102, where the central voltage VAFCENT read in is learned for correction by the use of the following equation (8):

$$VAFCENT=X_CREFX\times VAF+(1-X_CREFX)\times VAFCENT \quad (8)$$

where X_CREFX represents a predetermined averaging variable, VAF represents a value of the output voltage VAF from the LAF sensor 16 read in the present loop, and VAFCENT on the right side a value of the central voltage VAFCENT read in the present loop.

Figure 15:
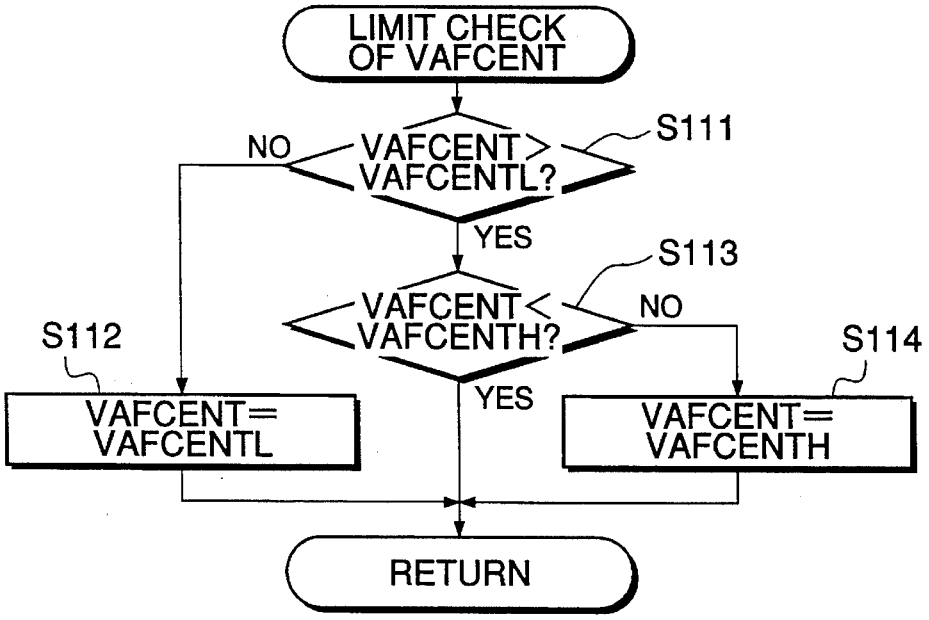
FIG. 15 is a flowchart showing a limit check routine for carrying out a limit check of a corrected VAFCENT value.

At the following step S103, a limit check of the corrected value of VAFCENT is executed by a VAFCENT limit check routine shown in FIG. 15 to thereby limit the corrected VAFCENT value within a range defined by predetermined upper and lower limit values. More specifically, as shown in FIG. 15, it is determined at a step S111 whether or not the corrected VAFCENT value is higher than a predetermined lower limit value VAFCENTL. If the answer to this question is negative (NO), the VAFCENT value is set to the predetermined lower limit VAFCENTL at a step S112, followed by terminating the program. On the other hand, if the answer is affirmative (YES), it is determined at a step S113 whether or not the VAFCENT value is lower than a predetermined higher limit value VAFCENTH. If the answer to this question is negative (NO), the VAFCENT value is set to the predetermined higher limit value VAFCENTH at a step S114, followed by terminating the program. Further, if the answer to the question of the step S113 is affirmative (YES), this means that the VAFCENT value falls within the range defined by the upper and lower limit values VAFCENTH and VAFCENTL, and hence the VAFCENT value calculated at the step S102 of the FIG. 14 routine is maintained, followed by terminating the program.

On the other hand, if the answer to the question of the step S101 is negative (NO), the VAFCENT value obtained in the immediately preceding loop is set to the present value at a step S104, followed by terminating the program to return to the FIG. 11 routine at a step S86 thereof.

At the step S86 of the FIG. 11 routine, the output voltage VAF from the LAF sensor 16 is corrected based on the VAFCENT value corrected by learning as described above, by the use of the following equation (9):

$$VAF=(VAFAD+VAFCI-VAFCENT)\times KPEX \quad (9)$$

where VAFAD represents a value of the output voltage VAF read in the present loop, VAFCI an initial value of VAFCENT, and VAFCENT the corrected value of the central voltage VAFCENT obtained at the step S85 of the FIG. 11 routine.

By the equation (9), the read-in value VAFAD of the output voltage VAF read in the present loop is corrected based on the corrected value of the central voltage VAFCENT.

Figure 16:
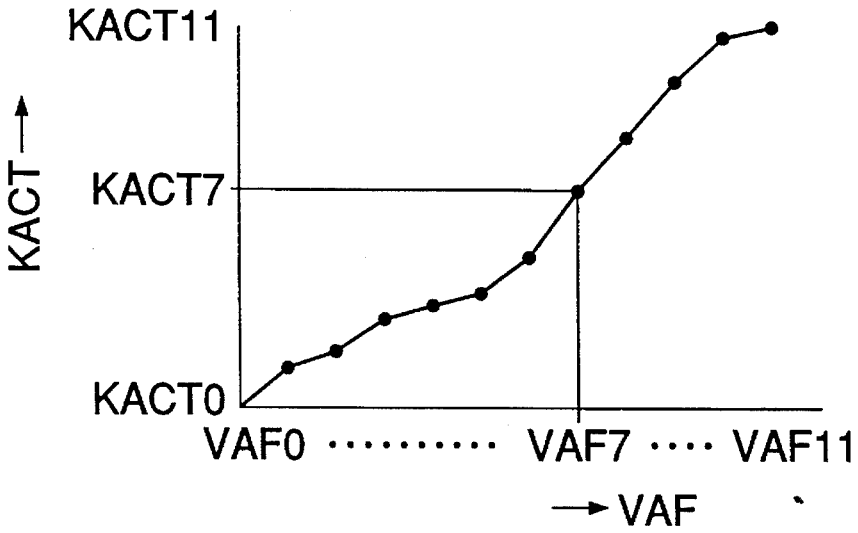
FIG. 16 shows a KACT table.

At the following step S87, the actual air-fuel ratio coefficient KACT is determined by retrieving a KACT table stored in the memory means 5*c* according to the corrected VAF value obtained at the step S86. The KACT table is set, e.g. as shown in FIG. 16, such that table values KACT0 to KACT11 correspond to predetermined values VAF0 to VAF11 of the output voltage VAF, assuming that the central voltage VAFCENT is equal to the aforementioned initial value VAF1. The actual air-fuel ratio coefficient KACT is determined by reading from the KACT table or interpolation of retrieved values. The actual air-fuel ratio coefficient KACT assumes a value which is substantially proportional to the VAF value.

As described above, according to the KACT-determining routine of the present embodiment, if there is an error in the central voltage VAFCENT output from the LAF sensor 16 which is caused e.g. by deviations from proper output characteristics of the LAF sensor 16 per se and/or variations of the amplifier circuit connected thereto, or aging of these devices, the error is corrected by learning the VAFCENT value by the use of the output voltage VAF at the step S85. Since the learning of the VAFCENT value for correction of the error is performed when the output from the O2 sensor 7 arranged downstream of the catalytic converter 15 falls within a range in which the maximum conversion efficiency of the catalytic converter 15 is obtained, it is possible to absorb variations of the output characteristic of the LAF sensor 16 to thereby control the air-fuel ratio to a range in which the maximum purifying efficiency of the catalytic converter 15 is obtained. Then, the output voltage VAF from the LAF sensor 16 read into the ECU 5 is corrected by the use of the learned VAFCENT value, and the KACT table is retrieved based on the corrected value of the output voltage VAF. This makes it possible to determine the actual air-fuel ratio coefficient KACT with high accuracy, which is corrected for the error in the central voltage VAFCENT.

As described above, according to the present embodiment, the central voltage VAFCENT as an output from the LAF sensor 16 is corrected by learning when the output from the O2 sensor 7 is within a range in which the maximum conversion efficiency of the catalytic converter 15 is obtained, and then the actual air-fuel ratio coefficient KACT is determined with high accuracy, which is corrected for an error in the central voltage VAFCENT from the LAF sensor into consideration. Therefore, it is possible to reliably control the air-fuel ratio of a mixture supplied to the engine to a stoichiometric value as a desired value in which the maximum purifying efficiency of the catalytic converter is obtained.

Next, a second embodiment of the invention will be described.

This embodiment is distinguished from the first embodiment in the O2 feedback processing executed at the step S44 of the FIG. 6 routine and the processing of learning the central voltage VAFCENT executed at the step S85 of the FIG. 11 routine. These processings in the present embodiment will be described in detail with reference to FIG. 17 and FIG. 18. However, in FIG. 17 showing the O2 feedback processing, steps S128 to S133 are identical to the steps S62 to S67 of the FIG. 8 routine described in the first embodiment, detailed description thereof will be omitted.

Figure 17:
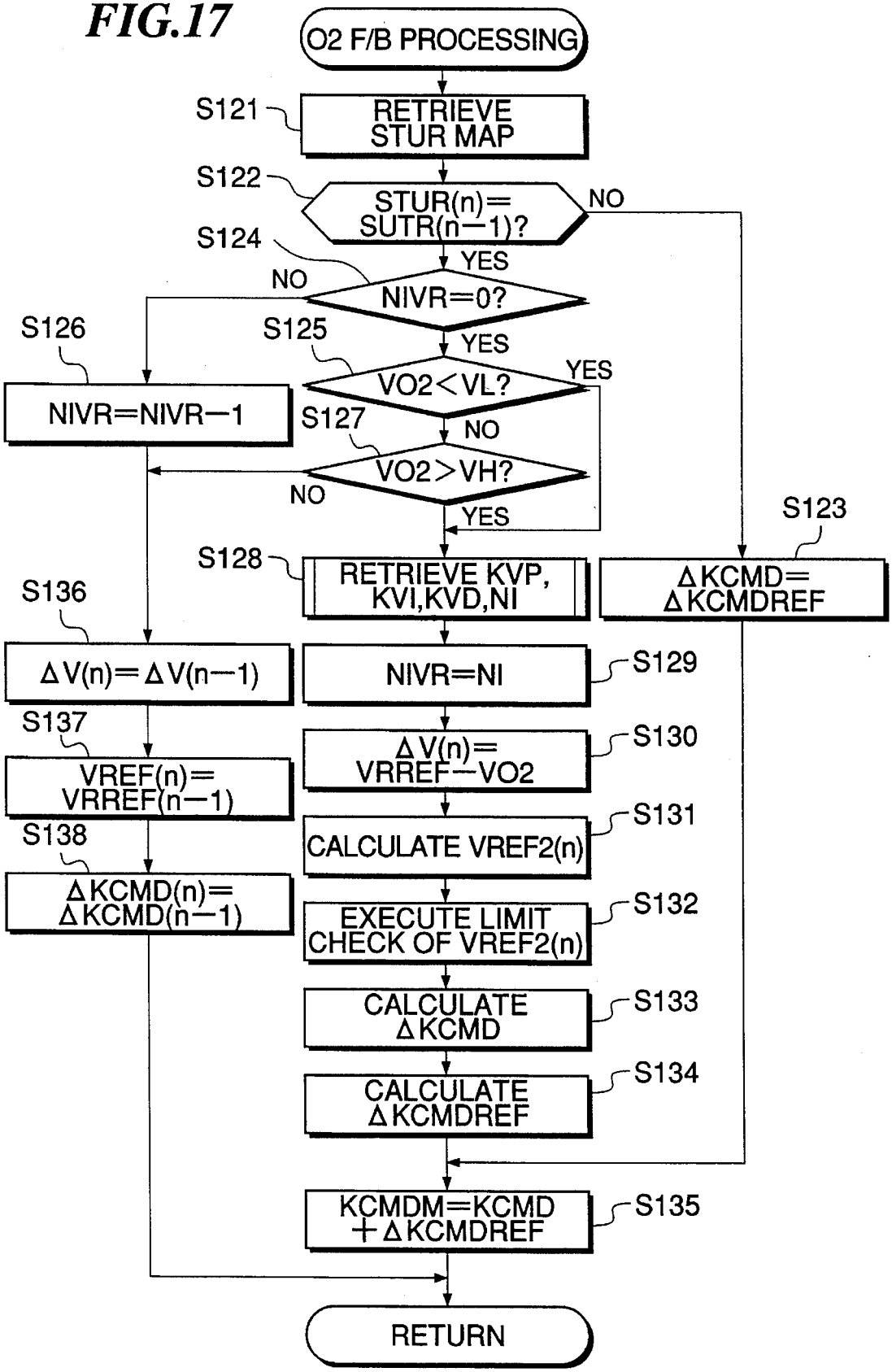
FIG. 17 is a flowchart showing an O2 feedback control routine executed by a second embodiment of the invention.

Referring to FIG. 17, there is shown an O2 feedback control routine of the second embodiment executed at the step S44 of the FIG. 6 routine. This routine is carried out in synchronism with generation of TDC signal pulses.

First, at a step S121, a STUR map is retrieved to determine an engine operating region STUR in which the engine is operating, and an average value ΔKCMDREF of the air-fuel ratio correction value a ΔKCMD (hereinafter this average value is referred to as "the learned value").

The STUR map is set such that operating regions STUR and values of the learned value ΔKCMDREF obtained in these respective regions correspond to predetermined values of the intake pipe absolute pressure PBA and predetermined values of the engine rotational speed NE. By retrieving this STUR map, the engine operating region STUR and the learned value ΔKCMDREF are determined. In this connection, the learned value Δ KCMDREF is calculated by an equation (10), referred to hereinafter, when the engine is operating in each of the above regions, and stored into the memory means 5*c*, as will be described later.

Next, at a step S122, it is determined whether or not the operating region STUR(n) determined in the present loop is the same as the operating region STUR(n-1) determined in the immediately preceding loop.

If the answer to this question is negative (NO), i.e. if the operating region STUR in the present loop has changed from that in the immediately preceding loop, the air-fuel ratio correction value a ΔKCMD is set to a learned value a ΔKCMDREF corresponding to the operating region STUR(n) in the present loop at the new step S123, and then the program proceeds to a step S135.

On the other hand, if the answer to the question of the step S122 affirmative (YES), the program proceeds to a step S124 where it is determined whether or not the thinning-out variable NIVR is equal to "0" The thinning-out variable NIVR is a variable which is reduced to 0 whenever the thinning-out number NI of TDC signal pulses are generated, as described hereinabove. The answer to the question of the step S124 in the first loop is affirmative (YES), since the variable NIVR has not been set to the number NI, so that the program proceeds to the step S125.

If the answer to the question of the step S124 becomes negative in a subsequent loop, the program proceeds to a step S126, where a decremental value of 1 is subtracted from the thinning-out variable NIVR to update the same, followed by the program proceeding to a step S136, referred to hereinafter.

At the step S125, it is determined whether or not the output voltage V02 from the O2 sensor 17 is lower than a predetermined lower limit value VL (e.g. 0.3V). If the answer to this question is affirmative (YES), it is judged that the air-fuel ratio of the mixture is biased from the stoichiometric value to a leaner value, and then the program proceeds to a step S128, whereas if the answer is negative (NO), the program proceeds to a step S127, where it is determined whether or not the output voltage VO2 from the O2 sensor 17 is higher than a predetermined upper limit value (e.g. 0.8). If the answer to this question is affirmative (YES), it is judged that the air-fuel ratio of the mixture is biased from the stoichiometric value to a richer value, and then the program proceeds to the step S128.

As stated hereinabove, since the following steps S128 to S133 are identical to the steps S62 to S67 of the FIG. 8 routine, description thereof is omitted.

Then, at a step S134, the learned value Δ KCMDREF(n) is calculated by the use of the following equation (10):

$$\Delta KCMDREF(n=(CREF/65536)\times\Delta KCMD+[(65536-CREF)/65536]\times\Delta KCMDREF(n-1) \quad (10)$$

where CREF represents a variable which is set, depending on operating conditions of the engine, to a proper value in the range of 1 to 65536, and Δ KCMDREF(n−1) the immediately preceding value of the learned value ΔKCMDREF. Thus, the air-fuel ratio correction value ΔKCMD is learned based on the immediately preceding value A KCMDREF(n−1) thereof to update the learned value ΔKCMDREF in each operating region STUR, which makes it possible to perform the air-fuel ratio feedback control, constantly by the use of a proper value of the desired air-fuel ratio coefficient free from the influence of aging of the O2 sensor 17, i.e. accurately to the stoichiometric air-fuel ratio.

Then, at a step S135, the learned value ΔKCMDREF is added to the desired air-fuel ratio coefficient KCMD determined at the step S22 of the FIG. 5 routine to calculate the modified desired air-fuel ratio coefficient KCMDM (equivalent to the stoichiometric air-fuel ratio), followed by terminating this routine.

On the other hand, if the answer to the question of the step S127 is negative (NO), i.e. if the output voltage V02 from the O2 sensor 17 is equal to or higher than the predetermined lower limit value VL but equal to or lower than the predetermined higher limit value VH, i.e. if VL≦VO2≦VH, the O2 feedback control should be inhibited, and hence the program proceeds to steps S136 to S138, where the aforementioned difference ΔV (between VRREF and VO2), the desired reference value VREF2, and the air-fuel ratio correction value ΔKCMD are held at the values assumed in the immediately preceding loop, respectively, followed by terminating the program. This prevents the O2 feedback control from being unnecessarily carried out when the air-fuel ratio of the mixture is determined to remain substantially equal to the stoichiometric value, to thereby attain excellent controllability, that is, to stabilize the air-fuel ratio of the mixture.

Figure 18:
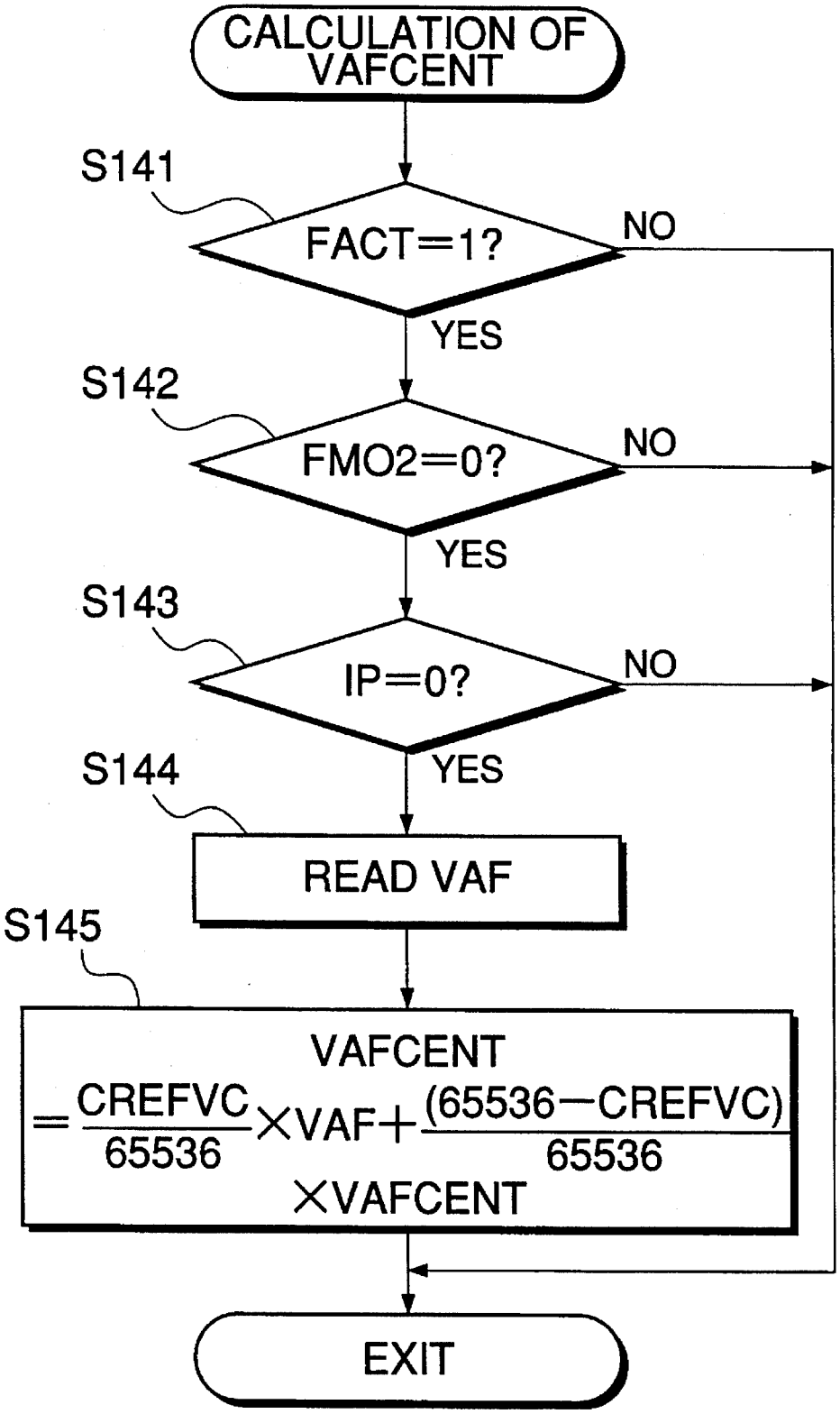
FIG. 18 is a flowchart showing a VAFCENT-correcting routine according to the second embodiment.

FIG. 18 shows a VAFCENT-correcting routine of the present embodiment executed at the step S85 of the FIG. 11 routine. This program is executed in synchronism with generation of TDC signal pulses.

First, at a step S141, it is determined whether or not a flag FACT, which is set to "1" when the LAF sensor 16 is in an activated state, is equal to "1". If the answer to this question is affirmative (YES), the program proceeds to a step S142. At the step S142, it is determined whether or not a flag FM02, which is set to "0" when the air-fuel ratio feedback control responsive to the output from the O2 sensor 17 is being carried out, is equal to "0". If the answer to this question is affirmative (YES), it is judged that the engine 1 is operating in a stable state with the airfuel ratio of a mixture supplied thereto being close to the stoichiometric air-fuel ratio, which is suitable for learning the value of the central voltage VAFCENT with high accuracy. Therefore, the program proceeds to a step s143, where the learning of the value of the central voltage VAFCENT is performed.

On the other hand, if the answer to the question of the step S141 or S142 is negative (NO), it is judged that the engine is not in an operating condition suitable for learning the value of the central voltage VAFCENT for correction of an error thereof, and then the program is terminated immediately.

At the step S143, it is determined whether or not the pumping current IP flowing through the line L appearing in FIG. 2 is equal to 0Δ. If the answer to this equation is affirmative (YES), i.e. if IP=0, this means that the direction of flow of the pumping current IP is about to be inverted, and hence it is judged that the air-fuel ratio of the mixture supplied to the engine is equal to the stoichiometric value. Then, the program proceeds to a step S144, where the output voltage VAF from the LAF sensor 16 is read in. In this connection, detection of the state IP=0 by the ECU 5 is effected such that a trigger is generated whenever IP=0 occurs, and the program proceeds to steps S144 et seq. only when the ECU 5 is supplied with this trigger.

At the following step S145, the value of the central voltage VAFCENT output from the LAF sensor 16 is corrected by the use of the following equation (11):

$$VAFCENT=(CREFVC/65536)\times VAF+[(65536CREFVC)/65536[\times VAFCENT \quad (11)$$

where CREFVC represents a predetermined averaging variable, and VAF a value of the output voltage from the LAF sensor read in the present loop. Then, the present routine is terminated.

As described above, according to the KACT-determining routine of the present embodiment, if there is an error in the central voltage VAFCENT output from the LAF sensor 16 which can be caused e.g. by aging of the LAF sensor 16 or variations in characteristics, etc. of the amplifier circuit connected to the LAF sensor 16, the error is corrected based on the output voltage VAF from the LAF sensor 16 obtained when the pumping current IP is about to be inverted in the direction of flow, by the use of the equation (11) at the step S145 of the FIG. 18 routine. Then, the output voltage VAF from the LAF sensor 16 read into the ECU 5 is corrected by the use of the corrected VAFCENT value, and further, the KACT table is retrieved based on the corrected value of the output voltage VAF. This makes it possible to determine the actual air-fuel ratio coefficient KACT with high accuracy, which is corrected for the error in the central voltage VAFCENT.

As described above, the actual air-fuel ratio coefficient KACT is determined with high accuracy, which is corrected for an error in the central voltage VAFCENT output from the LAF sensor 16, and further the desired air-fuel ratio coefficient KCMD is learned for correction of the supply air-fuel ratio, based on the output from the O2 sensor 17 arranged downstream of the catalytic converter. Therefore, it is possible to perform the air-fuel ratio control such that the desired air-fuel ratio is always equal to the stoichiometric value.

What is claimed is:

1. In an air-fuel ratio control system for an internal combustion engine having an exhaust passage, and a catalytic converter arranged in said exhaust passage for purifying noxious components contained in exhaust gases from said engine, said air-fuel ratio control system including a first exhaust gas component concentration sensor arranged in said exhaust passage at a location upstream of said catalytic converter and having an output characteristic which is substantially proportional to concentration of a specific component in said exhaust cases, and a second exhaust gas component concentration sensor arranged in said exhaust passage at a location downstream of said catalytic converter and having an output characteristic that an output therefrom drastically changes as an air-fuel ratio of a mixture supplied to said engine changes. across a stoichiometric air-fuel ratio, the improvement comprising:

central value-detecting means for detecting a central value of an output from said first exhaust gas component concentration sensor, said central value serving as a reference value based on which said first exhaust gas component concentration sensor delivers said output;

central value-correcting means for correcting said central value based on said output from said first exhaust gas component concentration sensor to obtain a corrected central value, when said output from said second exhaust gas component concentration sensor falls within a predetermined range;

output value-correcting means for correcting a value of said output from said first exhaust gas component concentration sensor, based on said corrected central value to obtain a corrected output value; and actual air-fuel ratio-calculating means for calculating an actual value of said air-fuel ratio of said mixture supplied to said engine, based on said corrected output value from said first exhaust gas component concentration sensor.

2. An air-fuel ratio control system according to claim 1, wherein said central value is corrected such that said central value accurately corresponds to a stoichiometric air-fuel ratio.

3. An air-fuel ratio control system according to claim 1, wherein said predetermined range of said output from said second exhaust gas component concentration sensor is set to a range in which said catalytic converter exhibits the maximum purifying efficiency.

4. An air-fuel ratio control system according to claim 2, wherein said predetermined range of said output from said second exhaust gas component concentration sensor is set to a range in which said catalytic converter exhibits the maximum purifying efficiency.

5. An air-fuel ratio control system according to claim 1, including engine operating condition-detecting means for detecting operating conditions of said engine, desired air-fuel ratio-determining means for determining a desired air-fuel ratio of said mixture supplied to said engine, based on results of detection by said engine operating condition-detecting means, desired air-fuel ratio-correcting means for correcting said desired air-fuel ratio determined by said desired air-fuel ratio-determining means, based on said output from said second exhaust gas component concentration sensor, and control means for controlling said air-fuel ratio of said mixture supplied to said engine, according to said corrected desired air-fuel ratio and said actual value of said air-fuel ratio calculated by said actual air-fuel ratio-calculating means.

6. An air-fuel ratio control system according to claim 2, including engine operating condition-detecting means for detecting operating conditions of said engine, desired air-fuel ratio-determining means for determining a desired air-fuel ratio of said mixture supplied to said engine, based on results of detection by said engine operating condition-detecting means, desired air-fuel ratio-correcting means for correcting said desired air-fuel ratio determined by said desired air-fuel ratio-determining means, based on said output from said second exhaust gas component concentration sensor, and control means for controlling said air-fuel ratio of said mixture supplied to said engine, according to said corrected desired air-fuel ratio and said actual value of said air-fuel ratio calculated by said actual air-fuel ratio-calculating means.

7. An air-fuel ratio control system according to claim 3, including engine operating condition-detecting means for detecting operating conditions of said engine, desired air-fuel ratio-determining means for determining a desired air-fuel ratio of said mixture supplied to said engine, based on results of detection by said engine operating condition-detecting means, desired air-fuel ratio-correcting means for correcting said desired air-fuel ratio determined by said desired air-fuel ratio-determining means, based on said output from said second exhaust gas component concentration sensor, and control means for controlling said air-fuel ratio of said mixture supplied to said engine, according to said corrected desired air-fuel ratio and said actual value of said air-fuel ratio calculated by said actual air-fuel ratio-calculating means.

8. An air-fuel ratio control system according to claim 4, including engine operating condition-detecting means for detecting operating conditions of said engine, desired air-fuel ratio-determining means for determining a desired air-fuel ratio of said mixture supplied to said engine, based on results of detection by said engine operating condition-detecting means, desired air-fuel ratio-correcting means for correcting said desired air-fuel ratio determined by said desired airffuel ratio-determining means, based on said output from said second exhaust gas component concentration sensor, and control means for controlling said air-fuel ratio of said mixture supplied to said engine, according to said corrected desired air-fuel ratio and said actual value of said air-fuel ratio calculated by said actual air-fuel ratio-calculating means.

9. In an air-fuel ratio control system for an internal combustion engine having an exhaust passage, and a catalytic converter arranged in said exhaust passage for purifying noxious components contained in exhaust gases from said engine, said air-fuel ratio control system including an exhaust gas component concentration sensor arranged in said exhaust passage at a location upstream of said catalytic converter for delivering an output based on a pumping current flowing therein and being substantially proportional to concentration of a specific component in said exhaust gases, the improvement comprising:

sensor activation-determining means for detecting an activated state of said exhaust gas component concentration sensor;

pumping current absence-detecting means for detecting a predetermined pumping current state of said exhaust gas component concentration sensor in which no pumping current flows therein;

central value-calculating means for calculating a central value of said output from said exhaust gas component concentration sensor to obtain a calculated central value, based on said output from said exhaust gas concentration sensor, when said activated state of said first exhaust gas component concentration sensor is detected and at the same time said predetermined pumping current state of said exhaust gas component concentration sensor is detected, said central value serving as a reference value based on which said exhaust gas component concentration sensor delivers said output;

output value-correcting means for correcting a value of said output from said exhaust gas component concentration sensor based on said calculated central value to obtain a corrected output value; and actual air-fuel ratio-calculating means for calculating an actual value of an air-fuel ratio of a mixture supplied to said engine, based on said corrected output value from said exhaust gas component concentration sensor.

10. An air-fuel ratio control system according to claim 9, wherein said central value-calculating means leans an average value of said central value.

11. An air-fuel ratio control system according to claim 9, including operating condition-detecting means for detecting operating conditions of said engine, desired air-fuel ratio-calculating means for calculating a desired air-fuel ratio of said mixture supplied to said engine, based on results of detection by said operating condition-detecting means, a second exhaust gas component concentration sensor arranged in said exhaust passage at a location downstream of said catalytic converter and having an output characteristic that an output therefrom drastically changes as said air-fuel ratio of said mixture supplied to said engine changes across a stoichiometric air-fuel ratio, correction value-learning means for learning a correction value for said desired air-fuel ratio, desired air-fuel ratio-correcting means for correcting said desired air-fuel ratio, based on said learned correction value, and control means for controlling said air-fuel ratio of said mixture supplied to said engine, based on said corrected desired air-fuel ratio and said actual value of said air-fuel ratio.

12. An air-fuel ratio control system according to claim 10, including operating condition-detecting means for detecting operating conditions of said engine, desired air-fuel ratio-calculating means for calculating a desired air-fuel ratio of said mixture supplied to said engine, based on results of detection by said operating condition-detecting means, a second exhaust gas component concentration sensor arranged in said exhaust passage at a location downstream of said catalytic converter and having an output characteristic that an output therefrom drastically changes as said air-fuel ratio of said mixture supplied to said engine changes across a stoichiometric air-fuel ratio, correction value-learning means for learning a correction value for said desired air-fuel ratio, desired air-fuel ratio-correcting means for correcting said desired air-fuel ratio, based on said learned correction value, and control means for controlling said air-fuel ratio of said mixture supplied to said engine, based on said corrected desired air-fuel ratio and said actual value of said air-fuel ratio.

* * * * *